US006947704B1

(12) United States Patent
Takasao et al.

(10) Patent No.: US 6,947,704 B1
(45) Date of Patent: Sep. 20, 2005

(54) POWER CONTROL APPARATUS, DIGITAL BROADCAST RECEPTION SYSTEM, TRANSMISSION POSTING APPARATUS, POWER STATE IDENTIFICATION APPARATUS, COMMUNICATION CUTOFF DECISION APPARATUS, STATE POSTING APPARATUS, STATE RECOGNITION APPARATUS, STATE RECOGNITION SYSTEM, AND DIGITAL BROADCAST TRANSMISSION/RECEPTION SYSTEM USING THEM

(75) Inventors: Kazuhiro Takasao, Kyoto (JP); Toshiaki Tsuji, Hyogo (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/539,315

(22) Filed: Mar. 30, 2000

(51) Int. Cl.[7] ..... H04H 7/00

(52) U.S. Cl. ..... 455/3.06; 455/3.02; 455/3.03; 725/149

(58) Field of Search ..... 455/3.06, 3.02, 455/15, 3.03, 522, 69; 725/149

(56) References Cited

U.S. PATENT DOCUMENTS 5,367,329 A 11/1994 Nakagaki et al.

FOREIGN PATENT DOCUMENTS

| | | | |
|---|---|---|---|
| EP | 0 415 717 A2 * | 3/1991 | ..... H04N 7/16 |
| EP | 0 452 717 A2 | 3/1991 | |
| WO | WO99/21309 | 4/1999 | |

* cited by examiner

*Primary Examiner*—Nick Corsaro
*Assistant Examiner*—Alan T. Gantt
(74) *Attorney, Agent, or Firm*—Wenderoth, Lind & Ponack, L.L.P.

(57) ABSTRACT

A digital broadcast transmission/reception system includes a transmission posting apparatus for performing a communication call through a telephone line network before a broadcast transmission apparatus starts transmitting individual information. The system also includes a distributor having a register which stores a transmitter ID signal of the transmission posting apparatus. The distributor compares a transmitter ID signal at the communication call with the transmitter ID signal stored in the register, outputs a power control signal when these ID signals match, and connects the telephone line network with a telephone when these ID signals do not match. The system also includes a power control apparatus for tuning ON power to a broadcast reception apparatus according to the power control signal. Therefore, the power to the broadcast reception apparatus can be controlled through the telephone line network.

9 Claims, 11 Drawing Sheets

POWER CONTROL APPARATUS, DIGITAL BROADCAST RECEPTION SYSTEM, TRANSMISSION POSTING APPARATUS, POWER STATE IDENTIFICATION APPARATUS, COMMUNICATION CUTOFF DECISION APPARATUS, STATE POSTING APPARATUS, STATE RECOGNITION APPARATUS, STATE RECOGNITION SYSTEM, AND DIGITAL BROADCAST TRANSMISSION/RECEPTION SYSTEM USING THEM

FIELD OF THE INVENTION

The present invention relates to a power control apparatus, a digital broadcast reception system, a transmission posting apparatus, a power status identification apparatus, a communication cutoff decision apparatus, a status posting apparatus, a status recognition apparatus, a status recognition system, and a digital broadcast transmission/reception system using them and, more particularly, to those which are used for digital broadcasting through which various kinds of information, such as EMM (Entitled Management Message), e-mail, accounting information, etc., are exchanged between a digital broadcast transmitter and a receiver.

BACKGROUND OF THE INVENTION

Digital broadcasting has already started in part of the current television broadcasting, and recently, multi-channel digital broadcasting has been rapidly advanced.

In digital broadcasting, a receiver receives a digital broadcast program by using an IRD (Integrated Receiver Decoder), which is a domestic reception apparatus that is connected with a television for analog broadcasting, and the receiver views the program that is digital-to-analog converted by the IRD.

FIG. 6 is a schematic diagram illustrating a conventional digital broadcast transmission/reception system. In FIG. 6, a broadcast center 701 has a digital broadcast transmission apparatus 70 which creates transmission data 9 of digital broadcasting and transmits the data. The transmission data 9 that is transmitted from the apparatus 70 is relayed by a relay center 2, such as a communication satellite, to each receiver 50. Each receiver 50 has a receiving antenna 73*a* and a broadcast reception apparatus 73 which is connected with a television. This broadcast reception apparatus 73 corresponds to the above-described IRD. The broadcast reception apparatus 73 has means for recording accounting information which is generated for each viewed program. Further, the broadcast reception apparatus 73 has communication means, such as a modem 75 or a terminal adapter, which is connected with a telephone line 300*b*, 300*d*, or 300*e*, and the broadcast reception apparatus 73 can transmit the accounting information through a telephone line network 300 by using this communication means. A customer center 702 has an information collection apparatus 11 which collects the accounting information and which is connected with a telephone line 300*c*.

The operation of the conventional digital broadcast transmission/reception system will now be described. An ordinary digital broadcast program is transmitted as transmission data 9 from the broadcast transmission apparatus 70 through the relay center 2 to the receiver 50, and the receiver 50 receives the transmission data 9 through the receiving antenna 73*a* by the broadcast reception apparatus 73. Then, the broadcast reception apparatus 73 decodes the data 9 and transmits an analog signal to the television (not shown), whereby the receiver 50 can view the program.

In digital broadcasting, in addition to ordinary program broadcasting, EMM (Entitlement Management Message) which is control information for descrambling scrambled data, electronic mail (e-mail) which is a message directed to a receiver, etc. are transmitted from the transmitting end, and these information which are directed to an individual (hereinafter referred to as "individual information") are also received by the IRD. Different EMMs are transmitted according to the IRDs of the respective receivers. EMM is transmitted at irregular intervals to each receiver and, therefore, the receiver cannot know when an EMM is transmitted. The same may be said of e-mail. That is, e-mail is transmitted according to the IRD of each receiver, and the receiver cannot know when an e-mail is transmitted. Accordingly, the IRD at the receiving end must be always in the power ON state so as to monitor and receive individual information such as EMM which is transmitted irregularly from the transmitting end.

On the other hand, in digital broadcasting, when the receiver has viewed a program of digital broadcasting, the charge for this program is accounted in many cases. To be specific, when an individual has viewed a program, accounting information is generated for the program and accumulated in the digital broadcast reception apparatus 73. A request signal for collecting the accounting information is transmitted as a kind of individual information from the transmitting end of the program through the digital broadcasting to the reception apparatus 73. Upon receipt of this request signal, the reception apparatus 73 transmits the accounting information to the customer center 702 of the transmitter through the telephone line network 300. The transmitter receives the accounting information by using the information collection apparatus 11, whereby the charge for programs that are viewed by each receiver can be calculated.

Since the reception apparatus 73 transmits the accounting information through the telephone line 300, the request signal for collecting the accounting information from the transmitter is usually transmitted during a time period where the telephone charge is inexpensive, for example, midnight. Although the receiver scarcely views digital broadcasts in this time period, the reception apparatus 73 must be set in the power ON state as to receive the accounting information request signal and to transmit the accounting information through the telephone line 300 after receiving the accounting information request signal.

By the way, in recent years, the prevention of global warming has been desired, and energy-saving type electric appliances for personal use have thus been demanded not only from industries but also from consumers. Accordingly, measures for energy saving are required of television reception apparatuses, and especially for digital broadcast reception apparatuses for which greater demand is expected.

However, as described above, even when the receiver (viewer) does not view a broadcast, the IRD must be always set in the power ON state so as to monitor and receive individual information such as EMM which is transmitted from the transmitter through the digital broadcasting. This IRD is far from an energy-saving type, and therefore, power saving of the IRD is demanded.

For this purpose, it is thought that the power to the IRD is turned OFF when the viewer does not view a program, except for a part of the IRD for receiving individual information, and the power to the entire IRD is turned ON when this part has received individual information that is transmitted through digital broadcasting. However, since both of the digital broadcast and the individual information are input in their encoded states, in order to decide whether the signal that is received by the part of the IRD is an ordinary digital broadcast or individual information, a part of the IRD for decoding the individual information which is included in the received broadcast must be in the power ON state. This decoding part consumes more than 50% of the power to the entire IRD, for example, about 5 w. Consequently, this measure cannot achieve the desired remarkable energy saving.

Therefore, in order to turn OFF the power to the greater part of the IRD while it does not receive a broadcast, the following measure has been proposed. That is, the IRD is provided with a control unit which is able to perform ON-control of power to the IRD and is connected to a public line such as a telephone line, and only this control unit is always set in the power ON state. Before transmitting an EMM or the like from the transmitter to the receiver, a communication call is made to this control unit by using the public line. When the call sound (i.e., the bell) has been rung a predetermined number of times, the control unit turns ON the power to the entire IRD. In this way, by controlling the power to the IRD from the distant transmitter through the communication line, the power of the IRD can be turned ON only when transmitting the individual information. Further, since the signal informing transmission of the individual signal (communication call signal) may be transmitted as a non-coded signal through a communication line such as a telephone line which is different from that for the digital broadcasting, the control unit does not need decoding means, and therefore, the power consumption can be reduced.

Meanwhile, the following alternative measure has been proposed. Every time the receiver turns ON or OFF the power, the reception apparatus phones the transmitting end through the modem or the like to post the ON or OFF state of the power of the reception apparatus to the transmitting end, whereby the transmitting end can grasp the power state of the reception apparatus. In this case, the transmitter transmits the individual information such as an EMM only when the reception apparatus is in the power ON state.

However, in general homes, one telephone line is branched into two lines to be connected to a telephone set and a broadcast reception apparatus, respectively, or one of a telephone set and a broadcast reception apparatus is connected through the other to a telephone line. Therefore, when the telephone line is used as means for posting the transmission of an EMM or the like from the transmitter to the receiver in advance of transmitting the EMM, the receiver cannot decide, in the stage of a communication call, whether it is sent to the telephone or to the broadcast reception apparatus, and as a result, the call sound (bell) of the telephone is rang. The signal (call) is connected to the broadcast reception apparatus only when the call sound has been rung by a predetermined number of times before the receiver picks up the telephone receiver or when the receiver has picked it up and decided that the signal (call) is directed to the broadcast reception apparatus. Accordingly, the call sound of the advance posting might trouble the receiver; for example, it might disturb the receiver's sleep. Therefore, it is very difficult to share the communication line between the telephone set and the control unit of the broadcast reception apparatus. However, if the call sound is not rung, the receiver cannot recognize a call to the telephone. Further, it is thought that the telephone set and the broadcast reception apparatus are connected to different telephone lines. In this case, however, the receiver should possess two telephone lines, and this is uneconomical because the telephone contract charge increases.

On the other hand, in the case where the receiving end phones the transmitting end every time the receiver turns the power ON or OFF to the broadcast reception apparatus so as to post the power ON or OFF state of the reception apparatus to the transmitting end, the telephone change is added at every power ON or OFF, regardless of the necessity of transmitting or receiving the individual information. This is uneconomical for the receiver.

SUMMARY OF THE INVENTION

The present invention is made to solve the above-described problems. Accordingly, an object of the present invention is to provide a power control apparatus, a digital broadcast reception system, a transmission posting apparatus, a power state identification apparatus, a communication cutoff apparatus, a state posting apparatus, a state recognition apparatus, and a state recognition system which can achieve energy saving of the digital broadcast reception system, and a digital broadcast transmission/reception system using them.

Other objects and advantages of the invention will become more apparent from the following detailed description. The detailed description and the specific embodiments described herein are provided only for illustration since various additions and modifications within the scope of the invention will be apparent to those of skill in the art from the detailed description.

According to a first aspect of the present invention, a power control apparatus comprises a distributor having storage means in which transmitter ID signals for identifying transmitters are stored. The distributor compares a transmitter ID signal which is input through a predetermined communication line in advance of a communication call signal with the transmitter ID signals stored in the storage means, outputs a power control signal when the inputted transmitter ID signal matches any of the stored transmitter ID signals, and connects the communication line with a predetermined communication apparatus when the inputted transmitter ID signal matches none of the stored transmitter ID signals. The power control apparatus also comprises a power control unit for controlling the ON or OFF power to a predetermined apparatus which is connected to the distributor, according to the power control signal which is supplied from the distributor. Therefore, the power of the predetermined apparatus such as a broadcast reception apparatus can be controlled from a distant place through the communication line. That is, the power of the apparatus can be turned ON only when it is used, and turned OFF while it is not used, and therefore, the power consumption of the apparatus is reduced, which results in energy saving. Further, since the power of the apparatus is controlled by using the transmitter ID signal without making the communication line go into the conversation state which is charged, the cost on the communication for power control can be reduced. Furthermore, the communication call for power control is distinguished from other ordinary communication calls by the transmitter ID signal, and the single communication line is switched between the predetermined apparatus and the above-described communication apparatus such as a telephone. Therefore, the communication call signal for power control does not bother the receiver.

According to a second aspect of the present invention, in accordance with the power control apparatus of the first aspect, the storage means stores a plurality of transmitter ID signals, the distributor outputs power control signals corresponding to the respective transmitter ID signals which are stored in the storage means and which match the inputted transmitter ID signals, and the power control unit performs control to turn the power of the predetermined apparatus ON and OFF according to the power control signals that are supplied from the distributor. Therefore, the power of the predetermined apparatus can be controlled by the transmitter ID signal alone, whereby the time required for the power control is reduced.

According to a third aspect of the present invention, in accordance with the power control apparatus of the second aspect, the storage means stores a transmitter ID signal corresponding to a predetermined process of the predetermined apparatus which is subjected to the power ON control or the power OFF control by the power control unit. When the inputted transmitter ID signal matches the stored transmitter ID signal, the distributor outputs a control signal for instructing the predetermined apparatus to perform the predetermined process corresponding to this transmitter ID signal. Therefore, a predetermined process of the predetermined apparatus other than power control can be controlled through the communication line.

According to a fourth aspect of the present invention, in accordance with the power control apparatus of the first aspect, the distributor is provided with count means for counting the communication call time by the communication call signal which is input after the transmitter ID signal through the predetermined communication line. Further, the storage means stores a plurality of communication call time information. When the inputted transmitter ID signal matches any of the stored transmitter ID signals, the distributor compares the result of the count by the count means with the communication call time information which is stored in the storage means, and outputs a power control signal corresponding to the communication call time information which matches the result of count, and the power control unit performs either the power ON control or the power OFF control according to the power control signal that is supplied from the distributor. Therefore, the power of the predetermined apparatus can be controlled by one transmitter ID signal.

According to a fifth aspect of the present invention, in accordance with the power control apparatus of the fourth aspect, the storage means stores communication call time information corresponding to a predetermined process of the predetermined apparatus which is subjected to the power ON or OFF control by the power control apparatus. When the result of the count by the count means matches the communication call time information which corresponds to the predetermined process of the predetermined apparatus and is stored in the storage means, the distributor outputs a control signal for instructing the predetermined apparatus to perform the predetermined process corresponding to this communication call time information. Therefore, a predetermined process of the predetermined apparatus other than power control can be controlled through the communication line.

According to a sixth aspect of the present invention, the power control apparatus of the first aspect further comprises termination decision means for deciding that the predetermined process of the predetermined apparatus is terminated, and outputting a power control signal to the power control unit to turn OFF the power of the predetermined apparatus. Therefore, when controlling the power of the predetermined apparatus, the transmitter ID signal is transmitted only when performing the power ON control, whereby the power control is facilitated.

According to a seventh aspect of the present invention, the power control apparatus of the first aspect further comprises time managing means for managing time, where the time managing means output, to the power control unit, either a power control signal to turn ON the power of the predetermined apparatus or a power control signal to turn OFF the power of the predetermined apparatus based on a predetermined time setting. Therefore, when controlling the power of the predetermined apparatus, the transmitter ID signal is transmitted only when performing either the power ON control or the power OFF' control, whereby the power control is facilitated.

According to an eighth aspect of the present invention, a digital broadcast reception system comprises reception means for receiving broadcast data of digital broadcasting, and a distributor having storage means in which transmitter ID signals for identifying transmitters are stored. The distributor compares a transmitter ID signal which is input through a predetermined communication line in advance of a communication call signal with the transmitter ID signals stored in the storage means, outputs a power control signal when the inputted transmitter ID signal matches any of the stored transmitter ID signals, and connects the communication line with a predetermined communication apparatus when the inputted transmitter ID signal matches none of the stored transmitter ID signals. The digital broadcast reception system also comprises a power control unit for controlling the ON or OFF power to the reception means according to the power control signal which is supplied from the distributor. Therefore, the power of the reception means can be controlled from a distant place through the communication line. That is, the power of the reception means can be turned ON only when it is used, and turned OFF while it is not used, and as a result, the power consumption of the whole system is reduced, which results in energy saving. Further, since the power of the reception means is controlled by using the transmitter ID signal without making the communication line go into the conversation state which is charged, the cost on the communication for power control can be reduced. Furthermore, the communication call for power control is distinguished from other ordinary communication calls by the transmitter ID signal, and the single communication line is switched between the predetermined apparatus and the above-described communication apparatus such as a telephone. Therefore, the communication call signal for power control does not bother the receiver.

According to a ninth aspect of the present invention, in accordance with the digital broadcast reception system of the eighth aspect, the storage means stores a plurality of transmitter ID signals, and the distributor outputs power control signals corresponding to the respective transmitter ID signals which are stored in the storage means and which match the inputted transmitter ID signals. Further, the power control unit performs control to turn the power of the predetermined apparatus ON and OFF according to the power control signals which are supplied from the distributor. Therefore, the power of the reception means can be controlled by only the transmitter ID signal, whereby the time required for power control is reduced.

According to a tenth aspect of the present invention, in accordance with the digital broadcast reception system of the ninth aspect, the reception means has transmission means for transmitting accounting information, which is generated with the reception of a digital broadcast, to a predetermined destination through the predetermined communication line, and the storage means stores a transmitter ID signal corresponding to execution of the process of transmitting the accounting information of the reception means. When the inputted transmitter ID signal matches the transmitter ID signal corresponding to the process of transmitting the accounting information, the distributor outputs a control signal for instructing the reception means to execute transmission of the accounting information by using the transmission means. Therefore, the process of making the reception means transmit the accounting information can be controlled through the communication line.

According to an eleventh aspect of the present invention, in accordance with the digital broadcast reception system of the eighth aspect, the distributor is provided with count means for counting the call time by the communication call signal which is input after the transmitter ID signal through the predetermined communication line, and the storage means stores a plurality of communication call time information. When the inputted transmitter ID signal matches any of the transmitter ID signals which are stored in the storage means, the distributor compares the result of the count by the count means with the communication call time information which is stored in the storage means, and outputs a power control signal corresponding to the communication call time information which matches the result of count. Further, the power control unit performs either the power ON control or the power OFF control according to the power control signal that is supplied from the distributor. Therefore, the power of the reception means can be controlled by using one transmitter ID signal.

According to a twelfth aspect of the present invention, in accordance with the digital broadcast reception system of the eleventh aspect, the reception means is provided with transmission means for transmitting accounting information, which is generated with the reception of a digital broadcast, to a predetermined destination through the predetermined communication line, and the storage means stores communication call time information corresponding to the process of transmitting the accounting information from the reception means. When the call time information corresponding to the process of transmitting the accounting information, which is stored in the storage means, matches the result of the count by the count means, the distributor outputs a control signal for instructing the reception means to transmit the accounting information by using the transmission means. Therefore, the process of making the reception means transmit the accounting information can be controlled through the communication line.

According to a thirteenth aspect of the present invention, the digital broadcast reception system of the eighth aspect further comprises termination decision means which decides that the predetermined operation of the reception means is terminated, and outputs a power control signal to the power control unit to turn OFF the power of the reception means. Therefore, when controlling the power of the reception means, the transmitter ID signal is transmitted only when performing the power ON control, whereby the power control is facilitated.

According to a fourteenth aspect of the present invention, a transmission posting apparatus comprises posting means capable of performing a communication call. The posting means is connected to a communication line which sequentially outputs a transmitter ID signal for identifying a transmitter and a communication call signal, and the posting means is provided correspondingly to either the transmission starting state or the transmission ending state when a predetermined transmission apparatus transmits information to a specific individual by using predetermined communication means which is different from the communication line. The transmission posting apparatus also comprises destination identification means for identifying the destination of the information to the individual on the communication line, before starting or after ending transmission of the information, and instructing the posting means corresponding Lo the transmission starting state or the transmission ending state to perform communication call. Therefore, in the case where the destination of the information is provided with reception means for the information, which can be controlled by the transmitter ID signal, the transmitter ID signal is received by the destination through the communication line when transmission of the information is started or when transmission of the information is ended, and ON/OFF of the power of the reception means can be controlled from a distant place, whereby the power consumption of the reception means is reduced to achieve energy saving. Further, since the power of the reception means is controlled by using the transmitter ID signal without making the communication line go into the conversation state which is charged, the cost on the communication for power control is reduced.

According to a fifteenth aspect of the present invention, the transmission posting apparatus of the fourteenth aspect further comprises posting means which is capable of performing a communication call. The posting means is connected to the communication line and corresponds to a predetermined process which is different from the start of transmission and the end of transmission. The destination identification means identify the destination of the information to the individual when instructing the individual to execute the predetermined process, and makes the posting means correspond to the predetermined process of performing a communication call. Therefore, it is possible to instruct the receiver of the information to perform the predetermined process.

According to a sixteenth aspect of the present invention, a transmission posting apparatus comprises posting means which is capable of performing a communication call. The posting means is connected with a communication line which sequentially outputs transmitter ID signal for identifying a transmitter and a communication call signal, and the posting means have count means for counting the call time of the communication call. The transmission posting apparatus also comprises destination identification means for identifying the destination of information to be transmitted to a specific individual on the communication line, before starting or after ending transmission of the information, when a predetermined transmission apparatus transmits the information to the individual by using predetermined transmission means which are different from the communication line. The destination identification means then makes the posting means perform a communication call and makes the count means count the communication call time, and terminates the communication call when the communication call time reaches a time which has previously been set according to the transmission starting state or the transmission ending state. Therefore, in the case where the destination of the information is provided with reception means for the information, which can he controlled by the transmitter ID signal, the transmitter ID signal is received by the destination through the communication line when transmission of the information is started or when it is ended, and ON/OFF of the power of the reception means can be controlled from a distant place, whereby the power consumption of the reception means is reduced to achieve energy saving. Further, since the power of the reception means is controlled by using the transmitter ID signal without making the communication line go into the conversation state which is charged, the cost on the communication for power control is reduced.

According to a seventeenth aspect of the present invention, in accordance with the transmission posting apparatus of the sixteenth aspect, the destination identification means makes the posting means perform a communication call to the destination when instructing the destination to execute a predetermined process, makes the count means count the communication call time, and terminates the communication call when the communication call time reaches a call time corresponding to the predetermined process. Therefore, it is possible to instruct the receiver of the information to perform the predetermined process.

According to an eighteenth aspect of the present invention, a digital broadcast transmission/reception system comprises a digital broadcast transmission system and a digital broadcast reception system. The digital broadcast transmission system comprises transmission means for transmitting broadcast data of digital broadcasting, and posting means which is capable of performing a communication call. The posting means is connected to a communication line which is different from that for the digital broadcasting and sequentially outputs a transmitter ID signal for identifying a transmitter and a communication call signal. The posting means is provided correspondingly to either the transmission starting state or the transmission ending state when the transmission means transmits information to a specific individual. The digital broadcast transmission system also comprises destination identification means for identifying the destination of the information to the individual on the communication line, before starting or after ending transmission of the information, and then instructing the posting means corresponding to the transmission starting state or the transmission ending state to perform a communication call. The digital broadcast reception system comprises reception means for receiving the broadcast data of digital broadcasting, and a distributor having storage means in which a transmitter ID signal of the posting means corresponding to either the transmission starting state or the transmission erecting state is stored. The distributor compares a transmitter ID signal which is input through the predetermined communication line in advance of the communication call signal when the posting means performs a communication call with the transmitter ID signal which is stored in the storage means. When the inputted transmitter ID signal matches the stored transmitter ID signal, the distributor outputs a power control signal corresponding to this transmitter ID signal. On the other hand, when the inputted transmitter ID signal does not match the stored transmitter ID signal, the distributor connects the communication line with a predetermined communication apparatus. The digital broadcast reception system also comprises a power control unit for turning ON the power of the reception means when the power control signal which is supplied from the distributor is based on the transmitter ID signal corresponding to the transmission starting state, and for turning OFF the power of the reception means when the power control signal is based on the transmitter ID signal corresponding to transmission end. Therefore, the power of the reception means can be controlled through the communication line. That is, the power of the reception means can be turned ON only when it is used, and is turned OFF while it is not used, whereby the power consumption of the digital broadcast reception system is reduced, which results in energy saving.

Further, since the power of the reception means is controlled by using the transmitter ID signal without making the communication line go into the conversation state which is charged, the cost on the communication for power control can be reduced. Furthermore, the communication call for power control is distinguished from other ordinary communication calls by the transmitter ID signal, and the single communication line is switched between the predetermined apparatus and the above-described communication apparatus such as a telephone. Therefore, the communication call signal for power control does not bother the receiver.

According to a nineteenth aspect of the present invention, in accordance with the digital broadcast transmission/reception system of the eighteenth aspect, the digital broadcast reception system further comprises posting means which is capable of performing a communication call.

The posting means is connected to the communication line and corresponds to a predetermined process which is different from the start of transmission start and the end of transmission. The destination identification means identifies the destination of the information to the individual when instructing the individual to execute the predetermined process, and then makes the posting means corresponding to the predetermined process perform a communication call. Therefore, it is possible to instruct the reception means, through the communication line, to perform the predetermined process.

According to a twentieth aspect of the present invention, in accordance with the digital broadcast transmission/reception system of the eighteenth aspect, the digital broadcast transmission system is provided with accounting information transmission posting means which performs a communication call for instructing the reception means to transmit accounting information which is generated with the reception of a digital broadcast. The storage means stores a transmitter ID signal which is transmitted when the accounting information transmission posting means performs a communication call. The reception means is provided with accounting information transmission means for transmitting the accounting information to a predetermined destination through a predetermined communication line. The distributor outputs, to the reception means, a control signal for instructing the reception means to transmit the accounting information by using the accounting information transmission means. Therefore, the process of making the reception means transmit the accounting information can be controlled through the communication line.

According to a twenty-first aspect of the present invention, a digital broadcast transmission/reception system comprises a digital broadcast transmission system and a digital broadcast reception system. The digital broadcast transmission system comprises transmission means for transmitting broadcast data of digital broadcasting, and posting means which is capable of performing a communication call. The posting means is connected to a communication line which successively outputs a transmitter ID signal for identifying a transmitter and a communication call signal, and the posting means has first count means for counting the call time of the communication call. The digital broadcast system also comprises destination identification means for identifying the destination of information to be transmitted to a specific individual on the communication line, before starting or after ending transmission of the information, when the transmission means transmits the information to the individual by digital broadcasting. The destination identification means then makes the posting means perform a communication call and makes the first count means count the communication call time, and terminates the communication call when the communication call time reaches a time which has previously been set according to the transmission starting state or the transmission ending state. The digital broadcast reception system comprises reception means for receiving the broadcast data of digital broadcasting, and a distributor having storage means for storing the transmitter ID signal and communication call time information which corresponds to either the start of transmission or the end of transmission. The distributor also has second counting means for counting the call time of the communication call signal which is input after the transmitter ID signal through the communication line. The distributor compares a transmitter ID signal which is input through the predetermined communication line in advance of the communication call signal with the transmitter ID signal which is stored in the storage means. When the inputted transmitter ID signal matches the stored transmitter ID signal, the distributor compares the result of the count by the second counting means with the communication call time information which is stored in the storage means, and outputs the communication call time information which matches the result of count. On the other hand, when the inputted transmitter ID signal does not match the stored transmitter ID signal, the distributor connects the communication line with a predetermined communication apparatus. The digital broadcast reception system also comprises a power control unit for turning ON the power of the reception means when the power control signal which is supplied from the distributor corresponds to the start of transmission, and for turning OFF the power of the reception means when the power control signal corresponds to the end of transmission. Therefore, the power of the reception means can be controlled through the communication line. That is, the power of the reception means can be turned ON only when it is used, and is turned OFF while it is not used, whereby the power consumption of the digital broadcast reception system is reduced, which results in energy saving. Further, since the power of the reception means is controlled by using the transmitter ID signal without making the communication line go into the conversation state which is charged, the cost on the communication for power control can be reduced. Furthermore, the communication call for power control is distinguished from other ordinary communication calls by the transmitter ID signal, and the single communication line is switched between the predetermined apparatus and the above-described communication apparatus such as a telephone. Therefore, the communication call signal for power control does not bother the receiver.

According to a twenty-second aspect of the present invention, in accordance with the digital broadcast transmission/reception system of the twenty-first aspect, when instructing the destination of the information to the individual to execute the predetermined process, the destination identification means makes the posting means perform a communication call to the destination and makes the first count means count the communication call time, and terminates the communication call when the communication call time reaches the call time corresponding to the predetermined process. The storage means stores communication call time information of the communication call for instructing execution of the predetermined process. The distributor compares the result of the count by the second counting means with the stored communication call time information, and when the result of the count matches the communication call time information, the distributor outputs a control signal for instructing the reception means to execute the predetermined process. Therefore, the digital broadcast transmission system can control the predetermined process of the reception means, other than power ON/OFF, through the communication line.

According to a twenty-third aspect of the present invention, in accordance with the digital broadcast transmission/reception system of the twenty-first aspect, when instructing the destination of the information to transmit accounting information which is generated with the reception of a digital broadcast, the destination identification means makes the posting means perform a communication call to the destination and makes the first count means count the communication call time, and terminates the communication call when the communication call time reaches the call time corresponding to the transmission of the accounting information. The reception means includes accounting information transmission means for transmitting the accounting information to a predetermined destination through a predetermined communication line. The storage means stores call time information of the communication call which is performed for transmitting the accounting information. The distributor compares the result of the count by the second counting means with the stored communication call time information, and when the result of count matches the communication call time information, the distributor outputs a control signal for instructing the reception means to transmit the accounting information by using the accounting information transmission means. Therefore, the digital broadcast transmission system can control the process of making the reception means transmit the accounting information through the communication line.

According to a twenty-fourth aspect of the present invention, a power state identification apparatus comprises storage means in which transmitter ID signals for identifying transmitters are stored, power state identification means for identifying the power state of a predetermined apparatus and holding the power state, and communication cutoff means for cutting off communication through a predetermined communication line. A transmitter ID signal which is input through the predetermined communication line in advance of a communication call signal is compared with the transmitter ID signals which are stored in the storage means. When the inputted transmitter ID signal matches any of the stored transmitter ID signals, it is decided whether the power state of the predetermined apparatus is in a predetermined state or not based on the power state information which is held in the power state identification means. When the predetermined apparatus is in the predetermined power state, the communication through the communication line is cut off by the communication cutoff means. On the other hand, when the inputted transmitter ID signal matches none of the stored transmitter ID signals, the communication line is connected with a predetermined communication apparatus. Therefore, according to whether the communication is cut off or not, the specific transmitter can identify the power state of the predetermined apparatus from a distant place through the communication line. That is, the transmitter transmits information to the predetermined apparatus only when the apparatus is in the power ON state, and it is not necessary to always set the apparatus in the power ON state for receiving the information, which results in energy saving. Further, since the power of the apparatus is controlled by using the transmitter ID signal without making the communication line go into the conversation state which is charged, the cost on the communication for power control can be reduced. Furthermore, the communication call for power control is distinguished from other ordinary communication calls by the transmitter ID signal, and the single communication line is switched between the predetermined apparatus and the above-described communication apparatus such as a telephone. Therefore, the communication call signal for power control does not bother the receiver.

According to a twenty-fifth aspect of the present invention, a power state identification apparatus comprises storage means in which transmitter ID signals for identifying transmitters are stored, power state identification means for identifying the power state of a predetermined apparatus and holding this identification information, counting means for counting the call time of a communication call signal which is input subsequent to the transmitter ID signal through the predetermined communication line, and communication cutoff means for cutting off communication through the predetermined communication line. A transmitter ID signal which is input through the predetermined communication line is compared with the transmitter ID signals which are stored in the storage means. When the inputted transmitter ID signal matches any of the stored transmitter ID signals, the power state of the predetermined apparatus is decided based on the power state information which is held in the power state identification means, and the communication call signal is counted by the counting means. When the call time being counted reaches a predetermined time, the communication is cut off by using the communication cutoff means. On the other hand, when the inputted transmitter ID signal matches none of the stored transmitter ID signals, the communication line is connected with a predetermined communication apparatus. Therefore, according to whether the communication is cut off or not, the specific transmitter can identify the power state of the predetermined apparatus from a distant place through the communication line. That is, the transmitter transmits information to the predetermined apparatus only when the apparatus is in the power ON state, and it is not necessary to always set the apparatus in the power ON state for receiving the information, which results in energy saving. Further, since the power of the apparatus is controlled by using the transmitter ID signal without making the communication line go into the conversation state which is charged, the cost on the communication for power control can be reduced. Furthermore, the communication call for power control is distinguished from other ordinary communication calls by the transmitter ID signal, and the single communication line is switched between the predetermined apparatus and the above-described communication apparatus such as a telephone. Therefore, the communication call signal for power control does not bother the receiver.

According to a twenty-sixth aspect of the present invention, a communication cutoff decision apparatus comprises posting means for performing a communication call to a predetermined destination. The posting means is connected to a communication line which sequentially outputs a transmitter ID signal for identifying a transmitter and a communication call signal. The communication cutoff decision apparatus also comprises decision means for deciding whether or not the communication by the posting means is cut off by the destination. Therefore, when the destination is provided with a predetermined apparatus which performs a cutoff of communication based on the power state or the like, the power state of the apparatus at the destination can be confirmed from a distant place. Thereby, when transmitting information to a broadcast reception apparatus or the like of the destination, the power state of the apparatus can be confirmed, and transmission of the information can be performed according to the power state. In this case, it is not necessary to always set the broadcast reception apparatus in the power ON state, which results in energy saving. Further, since the power state of the reception apparatus is identified by using the transmitter ID signal without making the communication line go into the conversation state which is charged, the cost on the communication for identifying the power state can be reduced.

According to a twenty-seventh aspect of the present invention, a communication cutoff decision apparatus comprises posting means for performing a communication call to a predetermined destination. The posting means is connected to a communication line which sequentially outputs a transmitter ID signal for identifying a transmitter and a communication call signal. The communication cutoff decision apparatus also comprises decision means for deciding whether or not the communication by the posting means is cut off by the destination, and counting the communication call time until the communication call signal from the posting means is cut off. Therefore, when the destination is provided with a predetermined apparatus which performs a cutoff of communication based on the power state or the like, the power state of the apparatus at the destination can be confirmed from a distant place. Thereby, when transmitting information to a broadcast reception apparatus or the like of the destination, the power state of the apparatus can be confirmed, and transmission of the information can be performed according to the power state. In this case, it is not necessary to always set the broadcast reception apparatus always in the power ON state, which results in energy saving. Further, since the power state of the reception apparatus is identified by using the transmitter ID signal without making the communication line go into the conversation state which is charged, the cost on the communication for identifying the power state can be reduced.

According to a twenty-eighth aspect of the present invention, a digital broadcast transmission/reception system comprises a digital broadcast transmission system and a digital broadcast reception system. The digital broadcast transmission system comprises transmission means for transmitting broadcast data of digital broadcasting, and posting means which is connected with a communication line that is different from that for the digital broadcasting, where the communication line sequentially outputs a transmitter ID signal for identifying a transmitter and a communication call signal. The digital broadcast transmission system also comprises destination identification means for identifying the destination of information to be transmitted to a specific individual on the communication line when transmitting the information through the digital broadcasting, and making the posting means perform a communication call to the destination of the information. The digital broadcast transmission system also comprises decision means for deciding whether or not the communication call by the posting means is cut off by the destination. The digital broadcast reception system comprises reception means for receiving the broadcast data of digital broadcasting, and a power state identification unit which includes storage means for storing a transmitter ID signal for identifying the communication call from the posting means, a power state identification means for identifying the power state of the reception means and holding it, and communication cutoff means for cutting the communication through the communication line. The power state identification unit compares a transmitter ID signal which is input through the communication line in advance of the communication call signal with the transmitter ID signal stored in the storage means. When the inputted transmitter ID signal matches the stored transmitter ID signal, it is decided whether or not the power state of the reception means is in a predetermined state based on the power state information which is held in the power state identification means. When the power state of the reception means is in the predetermined state, the communication through the communication line is cut off by the communication cutoff means. On the other hand, when the inputted transmitter ID signal does not match the stored transmitter ID signal, the predetermined communication line is connected with a predetermined communication apparatus. In this system, the decision means stores information indicating the relationship between the power state of the reception means and the cutoff of the communication call, and compares the stored information with the result of cutoff of the communication call to decide the power state of the reception means. The transmission means decides whether or not the information to the individual should be transmitted based on the power state of the reception means which has been decided by the decision means. Since the power state of the reception apparatus can be conformed from a distant place to decide whether or not the information should be transmitted to the reception apparatus, unnecessary transmission is avoided. Further, since the digital broadcast transmission system identifies the power ON state of the reception means to transmit the information, it is not necessary to set the reception means in the power ON state when not viewing a program, which results in energy saving. Further, since the power state of the reception means is identified by using the transmitter ID signal without making the communication line go into the conversation state which is charged, the cost on the communication for identifying the power state is reduced. Furthermore, the communication call for power control is distinguished from other ordinary communication calls by the transmitter ID signal, and the single communication line is switched between the predetermined apparatus and the above-described communication apparatus such as a telephone. Therefore, the communication call signal for power control does not bother the receiver.

According to a twenty-ninth aspect of the present invention, a digital broadcast transmission/reception system comprises a digital broadcast transmission system and a digital broadcast reception system. The digital broadcast transmission system comprises transmission means for transmitting broadcast data of digital broadcasting, and posting means which is connected with a communication line that is different from that for the digital broadcasting, where the communication line sequentially outputs a transmitter ID signal for identifying a transmitter and a communication call signal. The digital broadcast transmission system also comprises destination identification means for identifying the destination of information to be transmitted to a specific individual on the communication line when transmitting the information through the digital broadcasting, and making the posting means perform communication call to the destination of the information. The digital broadcast transmission system also comprises decision means for deciding whether or not the communication by the posting means is cut off by the destination, and counting the communication call time unit the communication call signal from the posting means is cut off. The digital broadcast reception system comprises reception means for receiving the broadcast data of digital broadcasting, and a power state identification unit which includes storage means in which a transmitter ID signal for identifying the communication call from the posting means is stored, power state identification means for identifying the power state of the reception means and holding it, counting means fur counting the call time of the communication call signal which is input after the transmitter ID signal through the communication line, and communication cutoff means for cutting the communication through the communication line. The power state identification unit compares a transmitter ID signal which is input through the communication line with the transmitter ID signal which is stored in the storage means. When the inputted transmitter ID signal matches the stored transmitter ID signal, the communication call signal is counted by the counting means, and the power state of the reception means is decided based on the power state information which is held in the power state identification means. When the communication call time being counted y the counting means reaches a predetermined call time according to the power state, the communication is rut off by the communication cutoff means. On the other hand, when the inputted transmitter ID signal does not match the stored transmitter ID signal, the predetermined communication line is connected with a predetermined communication apparatus. In this system, the decision means stores information indicating the relationship between the power state of the reception means and cutoff of the communication call, and compares the stored information with the result of the cutoff of the communication call to decide the power state of the reception means. Further, the transmission means decides whether or not the information to the individual should be transmitted based on the power state of the reception means which has been decided by the decision means. Since the power state of the reception apparatus can be conformed from a distant place to decide whether or not the information should be transmitted to the reception apparatus, unnecessary transmission is avoided. Further, since the digital broadcast transmission system identifies the power ON state of the reception means to transmit the information, it is not necessary to set the reception means in the power ON state when not viewing a program, which results in energy saving. Further, since the power state of the reception means is identified by using the transmitter ID signal without making the communication line go into the conversation state which is charged, the cost on the communication for identifying the power state is reduced. Furthermore, the communication call for power control is distinguished from other ordinary communication calls by the transmitter ID signal, and the single communication line is switched between the predetermined apparatus and the above-described communication apparatus such as a telephone. Therefore, the communication call signal for power control does not bother the receiver.

According to a thirtieth aspect of the present invention, a state posting apparatus is connected with a communication line which sequentially outputs a transmitter ID signal for identifying a transmitter at a communication call and a communication call signal and, immediately before or after the state of a predetermined apparatus changes to another predetermined state, the state posting apparatus performs a communication call to different destinations corresponding to the predetermined states, respectively. Therefore, the state of the predetermined apparatus can be posted to the predetermined destinations by making the destinations receive the transmitter ID signal. Thereby, when the predetermined destinations transmit information to the predetermined apparatus such as a broadcast reception apparatus, the power state of this apparatus is confirmed and the transmission is carried out according to the power state. Hence, it is not necessary to always set the predetermined apparatus in the power ON state, which results in energy saving. Further, since the state of the apparatus is posted by using the transmitter ID signal without making the communication line go into the conversation state which is charged, the cost on the communication for posting is reduced.

According to a thirty-first aspect of the present invention, a state posting apparatus is connected with a communication line which sequentially outputs a transmitter ID signal for identifying a transmitter at a communication call and a communication call signal and, immediately before or after the state of a predetermined apparatus changes to another predetermined state, the state posting apparatus performs a communication call to a predetermined destination so that the communication call time becomes a predetermined time corresponding to each of the predetermined states. Therefore, the state of the predetermined apparatus can be posted to the predetermined destination by making the destination receive the transmitter ID signal and the communication call signal. Thereby, when the predetermined destination transmits information to the predetermined apparatus such as a broadcast reception apparatus, the power state of this apparatus is confirmed and the transmission is carried out according to the power state. Hence, it is not necessary to always set the predetermined apparatus in the power ON state, which results in energy saving. Further, since the state of the apparatus is posted by using the transmitter ID signal without making the communication line go into the conversation state which is charged, the cost on the communication for posting is reduced.

According to a thirty-second aspect of the present invention, a state recognition apparatus comprises a plurality of identification means for identifying a transmitter from a transmitter ID signal which is posted through a predetermined communication line. The identification means are provided correspondingly to predetermined states of the transmitter. The state recognition apparatus also comprises information recognition means for deciding, amongst the plural identification means, identification means which has received the latest notification from the same transmitter, and recognizing that the transmitter is in the predetermined state corresponding to this identification means. Therefore, the state of the transmitter can be recognized, and information can be transmitted according to the state of a broadcast reception apparatus of the transmitter. At the transmitting end, it is not necessary to always set the power of the reception apparatus in the ON state, resulting in energy saving. Further, since the state of the transmitter is recognized by using the transmitter ID signal without making the communication line go into the conversation state which is charged, the cost on the communication of the transmitter is reduced.

According to a thirty-third aspect of the present invention, a state recognition apparatus comprises identification means for identifying a transmitter from a transmitter ID signal which is posted through a predetermined communication line, counting means for counting the call time of a communication call signal having a length corresponding to a predetermined state of the transmitter, where the signal is input after the transmitter ID signal, and information recognition means for deciding the call time of the latest communication call signal from the same transmitter based on the outputs from the identification means and the count means and for recognizing that the transmitter is in the predetermined state corresponding to this call time. Therefore, the state of the transmitter can be recognized, and information can be transmitted according to the state of a broadcast reception apparatus of the transmitter. At the transmitting end, it is not necessary to always set the power of the reception apparatus in the ON state, which results in energy saving. Further, since the state of the transmitter is recognized by using the. transmitter ID signal without making the communication line go into the conversation state which is charged, the cost on the communication of the transmitter is reduced.

According to a thirty-fourth aspect of the present invention, a state recognition system comprises a state posting apparatus which is connected with a communication line which sequentially outputs a transmitter ID signal for identifying a transmitter at a communication call and a communication call signal and, immediately before or after the state of a predetermined apparatus changes to another predetermined state, the state posting apparatus performs a communication call to predetermined different destinations corresponding to the predetermined states, respectively. The state recognition system also comprises a state recognition apparatus which includes a plurality of identification means for identifying a transmitter from a transmitter ID signal which is posted through the communication line. The identification means are provided correspondingly to predetermined states of the predetermined apparatus. The state recognition system further comprises information recognition means for deciding, amongst the plural identification means, identification means which has received the latest notification from the same transmitter, and recognizing that the predetermined apparatus is in the predetermined state corresponding to this identification means. Therefore, the state of the transmitter can be recognized, and information can be transmitted according to the state of a broadcast reception apparatus of the transmitter. At the transmitting end, it is not necessary to always set the power of the reception apparatus always in the ON state, which results in energy saving. Further, since the state of the transmitter is recognized by using the transmitter ID signal without making the communication line go into the conversation state which is charged, the cost on the communication of the transmitter is reduced.

According to a thirty-fifth aspect of the present invention, a state recognition system comprises a state posting apparatus which is connected with a communication line which sequentially outputs a transmitter ID signal for identifying a transmitter at communication call and a communication call signal and, immediately before or after the state of a predetermined apparatus changes to another predetermined state, the state posting apparatus performs a communication call to a predetermined destination so that the communication call time becomes a predetermined time corresponding to each of the predetermined states. The state recognition system also comprises a state recognition apparatus which includes identification means for identifying a transmitter from a transmitter ID signal posted through a predetermined communication line, counting means for counting the call time of a communication call signal having a length corresponding to a predetermined state of the transmitter, where the signal is input after the transmitter ID signal, and information recognition means for deciding the call time of the latest communication call signal from the same transmitter based on the outputs from the identification means and the count means, and for recognizing that the transmitter is in the predetermined state corresponding to this call time. Therefore, the state of the transmitter can be recognized, and information can be transmitted according to the state of a broadcast reception apparatus of the transmitter. At the transmitting end, it is not necessary to always set the power of the reception apparatus in the ON state, which results in energy saving. Further, since the state of the transmitter is recognized by using the transmitter ID signal without making the communication line go into the conversation state which is charged, the cost on the communication of the transmitter is reduced.

According to a thirty-sixth aspect of the present invention, a digital broadcast transmission/reception system comprises a digital broadcast reception system and a digital broadcast transmission system. The digital broadcast reception system comprises reception means for receiving broadcast data of digital broadcasting, and state posting means which is connected with a communication line which sequentially outputs a transmitter 1D signal for identifying a transmitter at communication call and a communication call signal and, immediately after the reception means goes into the power ON state or immediately before the reception means goes into the power OFF state, the state posting means performs a communication call to predetermined different destinations corresponding to the power ON state and the power OFF state of the reception means, respectively. The digital broadcast transmission system comprises transmission means for transmitting the broadcast data of digital broadcasting, and a state recognition apparatus which includes a plurality of identification means for identifying a transmitter from a transmitter ID signal which is supplied through the communication line, where the identification means are provided correspondingly to the power ON state and the power OFF state of the reception means, respectively, and information recognition means for deciding, amongst the plural identification means, identification means which has received the latest notification from the same transmitter, and for recognizing that the predetermined apparatus is in the power ON state or the power OFF state according to this identification means. When the reception means is in the power OFF state, the transmission means is controlled so that no information is transmitted to the reception means through the digital broadcasting. Therefore, the power state of the reception means can be recognized at the broadcast transmission system end, and the transmission system can transmit information to the reception means only when the reception means is in the power ON state, whereby unnecessary transmission is avoided. Further, since the information is transmitted to the reception means only when it is in the power ON state, the reception means can be set in the power OFF state when not viewing a program, which results in energy saving. Furthermore, since the state of the reception means is posted by using the transmitter ID signal without making the communication line go into the conversation state which is charged, the cost on the communication for posting is reduced.

According to a thirty-seventh aspect of the present invention, a digital broadcast transmission/reception system comprises a digital broadcast reception system and a digital broadcast transmission system. The digital broadcast reception system comprises reception means for receiving broadcast data of digital broadcasting, and state posting means which is connected with a communication line which sequentially outputs a transmitter ID signal for identifying a transmitter at communication call and a communication call signal and, immediately after the reception means goes into the power ON state or immediately before the reception means goes into the power OFF state, the state posting means performs a communication call to a predetermined destination so that the communication call time becomes a predetermined time corresponding to the power ON state or the power OFF state of the reception means. The digital broadcast transmission system comprises transmission means for transmitting the broadcast data of digital broadcasting, identification means for identifying a transmitter from a transmitter ID signal supplied through the communication line, counting means for counting the call time of the communication call signal which is input after the transmitter ID signal, and information recognition means for deciding the call time of the latest communication call signal from the same transmitter based on the output of the identification means and the result of the count by the counting means, and for recognizing that the reception means is in the power ON state or the power OFF state according to this call time. When the reception means is in the OFF state, the transmission means is controlled so that no information is transmitted to the reception means through the digital broadcasting. Therefore, the power state of the reception means can be recognized at the broadcast transmission system end, and the transmission system can transmit information to the reception means only when the reception means is in the power ON state, whereby unnecessary transmission is avoided. Further, since the information is transmitted to the reception means only when it is in the power ON state, the reception means can be set in the power OFF state when not viewing a program, which results in energy saving. Furthermore, since the state of the reception means is posted by using the transmitter ID signal and the communication call signal without making the communication line go into the conversation state which is charged, the cost on the communication for posting is reduced.

DETAILED DESCRIPTION OF THE INVENTION

FIRST EMBODIMENT

Figure 1:
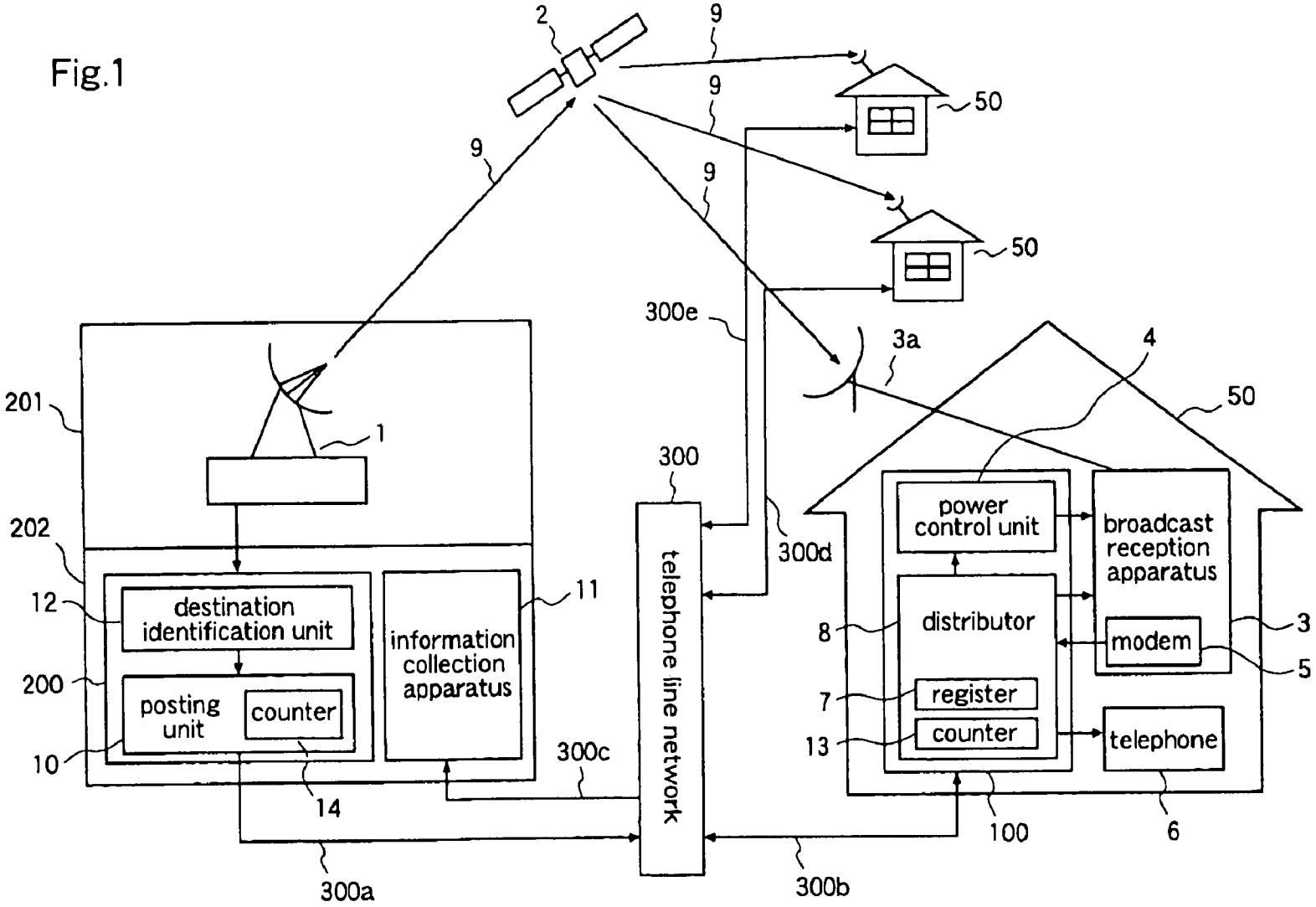
FIG. 1 is a diagram illustrating a digital broadcast transmission/reception system according to a first embodiment of the present invention.

FIG. 1 is a diagram for explaining a digital broadcast transmission/reception system according to a first embodiment of the present invention. In FIG. 1, a broadcast center 201 is provided with a digital broadcast transmission apparatus 1 which creates transmission data 9 of digital broadcasting and which transmits the transmission data 9. The transmission data 9 that is transmitted from the broadcast center 201 is relayed by a relay center 2 such as a communication satellite and is transmitted to each receiver 50. Each receiver 50 has a receiving antenna 3*a* and a broadcast reception apparatus 3 which is connected to a television (not shown). The broadcast reception apparatus 3 has means for recording accounting information which is generated with a viewed program. Further, the broadcast reception apparatus 3 has communication means such as a modem 5 or a terminal adapter, and the reception apparatus 3 can transmit the accounting information through a communication line such as a telephone line by using this communication means. Reference numeral 8 denotes a distributor for identifying the transmitter of the transmission data 9 by a transmitter ID signal which is described later, and the distributor 8 switches the connection of the telephone line (a power control unit 4 or a telephone 6). The distributor 8 comprises a register 7 and a counter 13 which counts the communication call time, and is connected with a telephone line 300*b*, 300*d*, or 300*e*. The distributor 8 is connected with a power control unit 4 which controls ON/OFF of power to the broadcast reception apparatus 3 and with a telephone 6, and the telephone line 300*b* is connected with either the power control unit 4 or the telephone 6 by the distributor 8. The power control unit 4 and the distributor 8 constitute a power control apparatus 100. The broadcast reception apparatus 3 and the power control apparatus 100 constitute a digital broadcast reception system. A customer center 202 is provided with a transmission posting apparatus 200 and an information collection apparatus 11. The transmission posting apparatus 200 is connected with a telephone line 300*a*, and the transmission posting apparatus 200 comprises a destination identification unit 12 and a posting unit 10. The information collection apparatus 11 is connected with a telephone line 300*c*, and collects accounting information and the like. The transmission posting apparatus 200, the information collection apparatus 11, and the broadcast transmission apparatus 1 constitute a digital broadcast transmission system. When the broadcast transmission apparatus 1 transmits information to one of the receivers 50, the destination identification unit 12 identifies the destination of the information on the telephone line, i.e., the telephone number of the receiver. The destination identification unit 12 is connected to the broadcast transmission apparatus 1 of the broadcast center 201 through a predetermined communication line or the like. The posting unit 10 has a counter 14. The posting unit 10 performs a communication call to the receiver of the information that is supplied from the destination identification unit 12 through the telephone line network 300. The counter 14 counts the call time of a communication call signal by the telephone line, i.e., the period of time during which the call sound (bell) is ringing. The posting unit 10 cuts the connection by the telephone line when the call time has reached a predetermined period. Instead of the counters 13 and 14, means for counting the number of intermittent communication call bells, i.e., the number of calls, may be employed. The telephone 6 is connected to the telephone line 300*b* through the distributor 8, and the telephone 6 may be connected with a predetermined communication unit such as a facsimile machine.

An ordinary digital broadcast program is transmitted as the transmission data 9 from the broadcast transmission apparatus 1 through the relay center 2 to the receiver 50, and the receiver 50 receives the transmission data 9 through the receiving antenna 3*a* by the broadcast reception apparatus 3. The broadcast reception apparatus 3 decodes the transmission data 9 and sends an analog signal to the television (not shown), whereby the receiver can view the program.

In digital broadcasting, by utilizing intervals between programs in the transmission data 9, an EMM (Entitlement Management Message) which is control information for descrambling the transmission data 9, an e-mail which is a message directed to each individual receiver, and a signal for collecting accounting information that is stored in the broadcast reception apparatus 3 are irregularly transmitted to the receiver. Hereinafter, a description will be given of the transmission of the above-described information to each individual receiver (hereinafter referred to simply as "individual information").

When the broadcast transmission apparatus 1 creates transmission data of individual information and transmits it to a specific receiver 50, initially, the destination identification unit 12 identifies that this information is to be transmitted to the specific receiver 50, and checks whether the destination on the telephone line network 300 corresponds to the receiver 50 to which the individual information is to be transmitted, i.e., the telephone number of the receiver 50. Then, the destination identification unit 12 outputs the telephone number to the posting unit 10 so as to make the posting unit 10 contact the receiver 50 by using the telephone line 300*a* and the telephone line network 300, in order words, to make the posting unit 10 phone the receiver 50.

In Japan, nowadays a service called "Number Display" is offered. In this service, when making a telephone call for conversation through the public telephone line, in advance of a call signal for generating a call sound (bell), the telephone number of the transmitter is transmitted as a transmitter ID signal to the receiver. At the receiving end, the telephone number of the transmitter is informed to the receiver by appropriate display means before the call sound starts ringing. Accordingly, when the posting unit 10 receives the telephone number and tries to contact the receiver 50 through the telephone line 300*a*, the telephone line network 300 and the telephone line 300*b*, a switchboard or the like in the telephone line network 300 connects the telephone line 300*a* with the telephone line 300*b* and transmits a transmitter ID signal to the receiver 50, and, subsequently, transmits a communication call signal for generating the call sound. At this time, in the posting unit 10, the counter 14 counts the time in which the communication call signal is transmitted (i.e., communication call time) until it reaches a predetermined period of time, whereby the communication call signal is transmitted for a predetermined period (length) of time which is set in advance to turn ON the power of the broadcast reception apparatus 3 of the receiver 50. The connection of the telephone lines 300*a* and 300*b* is cut off when the signal transmission is terminated.

On the other hand, the receiver 50, to which the individual information is transmitted, previously records, in the register 7 of the distributor 8, the transmitter ID signal of the posting unit 10 (i.e., the telephone number of the posting unit 10) and information about the communication call time corresponding to the control to turn ON the power of the broadcast reception apparatus 3. When the transmitter ID signal is transmitted through the telephone line 300*b*, it is initially decided whether or not this transmitter ID signal is recorded in the register 7.

When this transmitter ID signal is recorded in the register 7, the distributor 8 decides that the individual information is transmitted from the posting unit 10, and the counter 13 counts the call time of the communication call signal which is transmitted subsequently to the transmitter ID signal. Then, the result of the count of the call time is compared with the communication call time which is recorded in the register 7 and corresponds to the control to turn ON the power of the broadcast reception apparatus 3. When the result of the count is equal to the communication call time, a power control signal to turn ON the power of the broadcast reception apparatus 3 is transmitted to the power control unit 4. Upon receipt of this power control signal, the power control unit 4 performs control to turn ON the power of the broadcast reception apparatus 3. Thereby, the broadcast reception apparatus 3 is turned ON, and the broadcast reception apparatus 3 enters into the information receiving state. This power control unit 4 may be implemented by any means as long as it can control the power of the broadcast reception apparatus 3. For example, when a consent type power control unit is used, a domestic power supply may be connected with a power supply code of the broadcast reception apparatus via this power control unit.

When the transmitter ID signal is not recorded in the register 7, the distributor 8 decides that this signal is not transmitted from the posting unit 10, and connects the telephone line 300*b* with a communication apparatus such as the telephone 6 which is provided outside of (external to) the power control apparatus 100. Thereby, the call bell of the telephone 6 is rung by the communication call signal which is transmitted subsequently, and the receiver 50 knows that there is a telephone call.

In the state where the broadcast reception apparatus 3 is in the power ON state, when the individual information which has been transmitted from the broadcast transmission apparatus 1 as transmission data 9 of digital broadcasting is a signal for collecting the accounting information, the broadcast reception apparatus 3 which has received this signal transmits the stored accounting information to the information collection apparatus 11 of the customer center 202 through the telephone line 300*b*, the telephone line network 300 and the telephone line 300*c*, by using the modem 5. Although the modem 5 is connected to the telephone line 300*b* through the distributor 8, the modem 5 may be directly connected to a signal line which branches from the telephone line 300*b*.

When transmission of the individual information from the broadcast transmission apparatus 1 is ended or when the information collection apparatus 11 confirms that collection of the accounting information is ended, the posting unit 10 performs a communication call immediately after the end of the transmission of the individual information or immediately after the confirmation of the collection of the accounting information, and transmits a communication call signal to the receiver 50 for a predetermined period of time so as to power OFF of the broadcast reception apparatus 3. At the receiving end 50, a communication call time corresponding to the control to turn OFF the power of the broadcast reception apparatus 3 is previously stored in the register 7, in addition to the communication call lime corresponding to the control to turn ON the power of the broadcast reception apparatus 3. When it is decided that the transmitter ID signal is transmitted from the posting unit 10, the call time of the communication call signal is counted, and when the result of this count corresponds to the power OFF control of the broadcast reception apparatus 3, a power control signal to turn OFF the power is transmitted to the power control unit 4. Upon receipt of this power control signal, the power control unit 4 turns OFF the power of the broadcast reception apparatus 3. Thereby, the broadcast reception apparatus 3 can be set in the power OFF state after obtaining the individual information such as an EMM or after transmitting the accounting information.

In this first embodiment, a distant transmitter of digital broadcasting can control, by using telephone lines, the ON/OFF of power to a broadcast reception apparatus which is possessed by a specific receiver of the digital broadcasting. Accordingly, when the transmitter wants to transmit information to the specific receiver, even if the broadcast reception apparatus of the receiver is in the OFF state, the transmitter can turn the power to the reception apparatus ON so that the reception apparatus can receive the information, and the transmitter can turn the power to the reception apparatus OFF when transmission of the information is completed. Therefore, at the receiver's end, the broadcast reception apparatus 3 may be in the power OFF state when a program is not viewed, so long as only the power control apparatus 100 is in the power ON state. Since the power consumption of the power control apparatus 100 can be reduced to 0.1 W or lower, energy saving can be achieved with respect to the entire broadcast reception system comprising the power control apparatus 100 and the broadcast reception apparatus 3.

Since the transmission from the posting unit 10 is cut off when the communication call signal reaches a predetermined call time, the connection between the posting unit 10 at the transmitting end and the distributor 8 at the receiving end is cut off before they go into the conversation state. In a communication line such as a telephone line, a fee for a telephone conversation is generally charged only when the transmitter and the receiver enter into the conversation state. That is, the communication call is performed immediately before the conversation is no longer free of charge. Therefore, in this first embodiment, the communication call from the posting unit 10 is free of charge, and as a result, a reduction in overall cost is achieved.

Further, since the distributor 8 identifies the telephone call from the posting unit 10 by using the transmitter ID signal and does not connect this to the telephone 6, the communication call signal from the posting unit 10 never rings the telephone 6. On the other hand, with respect to communication call from another transmitter, the distributor 8 can ring the call bell of the telephone 6. Therefore, the communication call signal for controlling the power of the broadcast reception apparatus 3, which is transmitted from the posting unit 10, does not bother the receiver, and the power control apparatus 100 and the telephone 6 can share the single telephone line 300*b*.

In this first embodiment, ON/OFF of the power to the broadcast reception apparatus 3 is controlled by a transmitter ID signal and a communication call signal of a predetermined call time, which are transmitted when the posting unit 10 performs a communication call. However, besides the communication call signal of a communication call time according to the ON/OFF of the power, a communication call signal of a predetermined call time for requesting individual information such as accounting information may be determined in advance, and this signal is stored in the register 7 of the distributor 8. When the customer center 202 requests the individual information, the posting unit 10 performs a communication call so that the communication call signal of the predetermined call time according to the request for the individual information is output subsequently to the transmitter ID signal, and the receiver 50 receives this by the distributor 8. When the received communication call signal is equal to the communication call time information which is stored in the register 7, the distributor 8 outputs a control signal for instructing the broadcast reception apparatus 3 to transmit the individual information. Upon receipt of this control signal, the broadcast reception apparatus 3 transmits the individual information such as accounting information to the information collection apparatus 11 by using the modem 5 or the like. Also, in this case, the same effects as described above are achieved.

While the power control unit 4 is included in the power control apparatus 100 in the first embodiment, the power control unit 4 may instead be incorporated in the broadcast reception apparatus 3, with the same effects as described above.

SECOND EMBODIMENT

Figure 2:
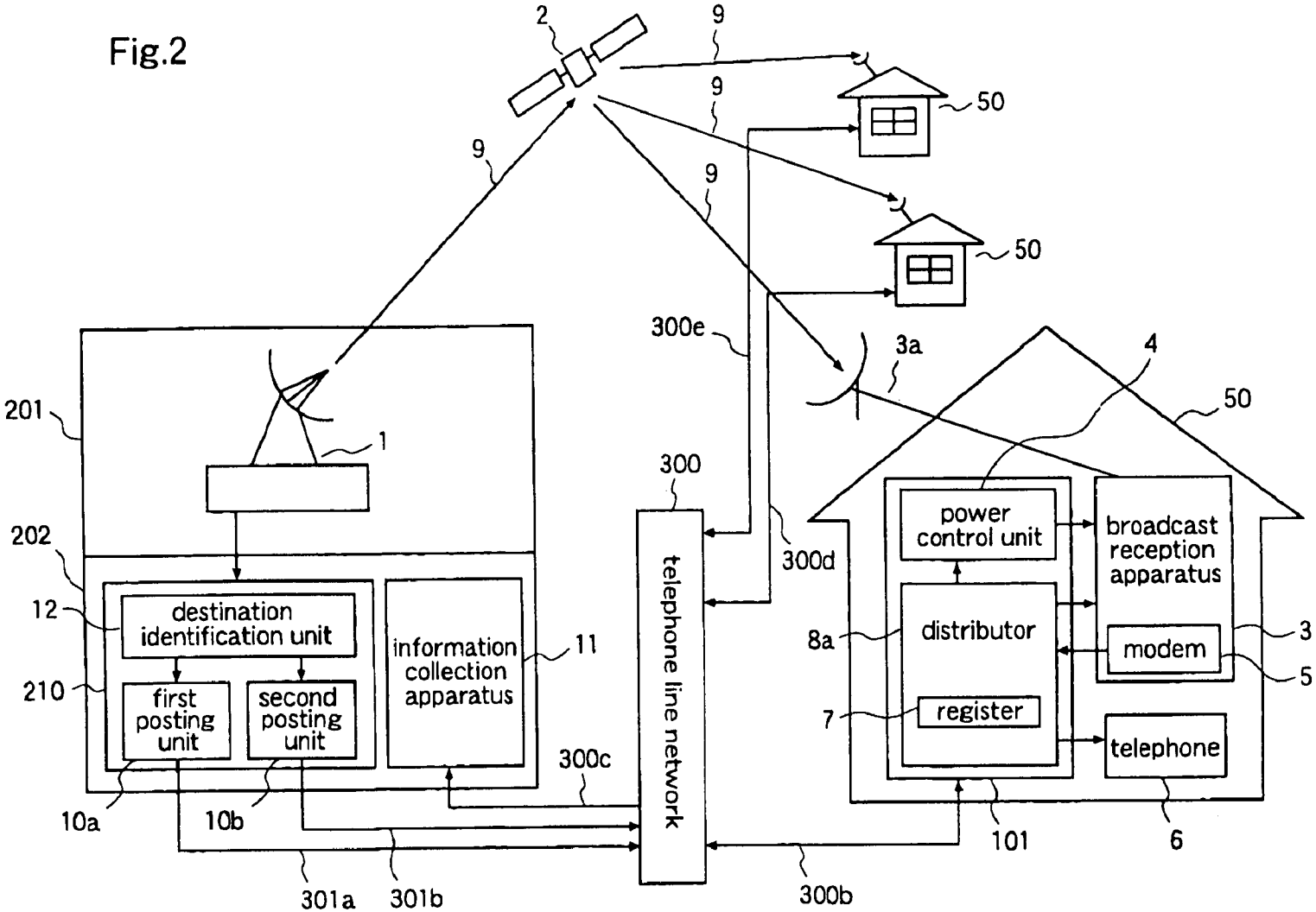
FIG. 2 is a diagram illustrating a digital broadcast transmission/reception system according to a second embodiment of the present invention.

FIG. 2 is a diagram illustrating a digital broadcast transmission/reception system according to a second embodiment of the present invention. This digital broadcast transmission/reception system is identical to the digital broadcast transmission/reception system of the first embodiment except for the following the posting unit and the distributor do not have counters, the transmission posting apparatus includes a plurality of posting units (in this second embodiment, two posting units) which are respectively connected to different telephone lines, and power to the broadcast reception apparatus is controlled according to different transmitter ID signals which are supplied from the respective posting units.

In FIG. 2, the same reference numerals as those shown in FIG. 1 denote the same or corresponding parts. A power control apparatus 101 comprises a power control unit 4 and a distributor 8*a* having a register 7. A transmission posting apparatus 210 comprises a destination identification unit 12, and first and second posting units 10*a* and 10*b*. The first and second posting units 10*a* and 10*b* are connected to a telephone line network 300 through a telephone line 301*a* and a telephone line 301*b*, respectively, so as to transmit different transmitter ID signals. The first and second posting units 10*a* and 10*b* may be connected to the telephone line network 300 through any means so long as the first and second posting units 10*a* and 10*b* can transmit different transmitter ID signals.

Next, the operation of the system will be described when individual information is transmitted. Initially, transmitter ID signals to be transmitted when the first and second posting units 10*a* and 10*b* perform communication calls are stored in advance in the register 7 of the distributor 8*a*. Further, controls to be performed on the broadcast reception apparatus 3 when the first and second posting units 10*a* and 10*b* perform communication calls are set in advance. For example, it is predetermined that power to the broadcast reception apparatus 3 is turned ON when receiving a communication call from the first posting unit 10*a*, and power to the broadcast reception apparatus 3 is turned OFF when receiving a communication call from the second posting unit 10*b*.

Immediately before the broadcast transmission apparatus 1 starts transmission of individual information to a specific receiver, the destination identification unit 12 of the transmission posting apparatus 210 identifies the destination (receiver) of the individual information on the telephone line network 300, and instructs the first posting unit 10*a*, which outputs a transmitter ID signal corresponding to power ON of the broadcast reception apparatus 3 at a communication call, to perform communication call Lo the destination (receiver) which is identified by the destination identification unit 12.

When the power control apparatus 101 receives this communication call, the distributor 8 compares the transmitter ID signal which is input through the telephone line 300*b* with the transmitter ID signals which are stored in the register 7. when the inputted transmitter ID signal is equal to any of the transmitter ID signals stored in the register 7, the distributor 8 outputs a control signal for performing control on the broadcast reception apparatus 3, which control has been predetermined according to the transmitter ID signal. In this second embodiment, since the transmitter ID signal is transmitted from the first posting unit 10*a*, a power control signal to make the power control unit 4 turn the power of the broadcast reception apparatus 3 is ON output to the power control unit 4. Upon receipt of this power control signal, the power control unit 4 turns ON the power of the broadcast reception apparatus 3, whereby the broadcast reception apparatus 3 enters into the information receiving state and, thereafter, the broadcast reception apparatus 3 receives the individual information which is transmitted as transmission data 9.

After the transmission of digital broadcasting is completed, the destination identification unit 12 identifies the destination (the specific receiver) of the individual information on the telephone line network 300, and instructs the second posting unit 10*b*, which outputs a transmitter ID signal corresponding to power OFF of the broadcast reception apparatus 3, to perform a communication call to the destination which is identified by the transmission identification unit 12. The operation after reception of this signal (communication call) is identical to that described for the power ON control. That is, the distributor 8 identifies the transmitter ID signal from the second posting unit 10*b*, and outputs a power control signal to the power control unit 4 for making the power control unit 4 turn OFF the power to the broadcast reception apparatus 3. Upon reception of this power control signal, the power control unit 4 turns OFF the power to the broadcast reception apparatus 3.

When the transmitter ID signal which is input through the telephone line 300*b* is not equal to any of the transmitter ID signals stored in the register 7, the telephone line 300*b* is connected to the telephone 6 as described above for the first embodiment.

Also, in this second embodiment, the same effects as those described for the first embodiment are achieved. Further, since there is no need to transmit a communication call signal after the transmitter ID signal, the communication call time of each posting unit is reduced, whereby the time which is required for controlling the broadcast reception apparatus is reduced.

While ON and OFF of power to the broadcast reception apparatus 3 are described in the second embodiment, only one of them may be performed. In this case, at least one posting unit is required.

While ON and OFF of power to the broadcast reception apparatus 3 are controlled in the second embodiment, controls other than power ON and OFF may be performed on the broadcast reception apparatus 3, such as control to make the reception apparatus 3 transmit individual information may be performed, for example. In this case, the number of posting units which are connected to different telephone lines is increased by at least one, and a transmitter ID signal from this at least one additional posting unit posting unit is also stored in the register 7, in association with a specific control, such as controlling transmission of accounting information or the like. When transmission of the transmitter ID signal from the added posting unit is identified by the distributor 8, the broadcast reception apparatus 3 is controlled so as to transmit the accounting information. This case will be described in more detail with reference to FIG. 10.

Figure 10:
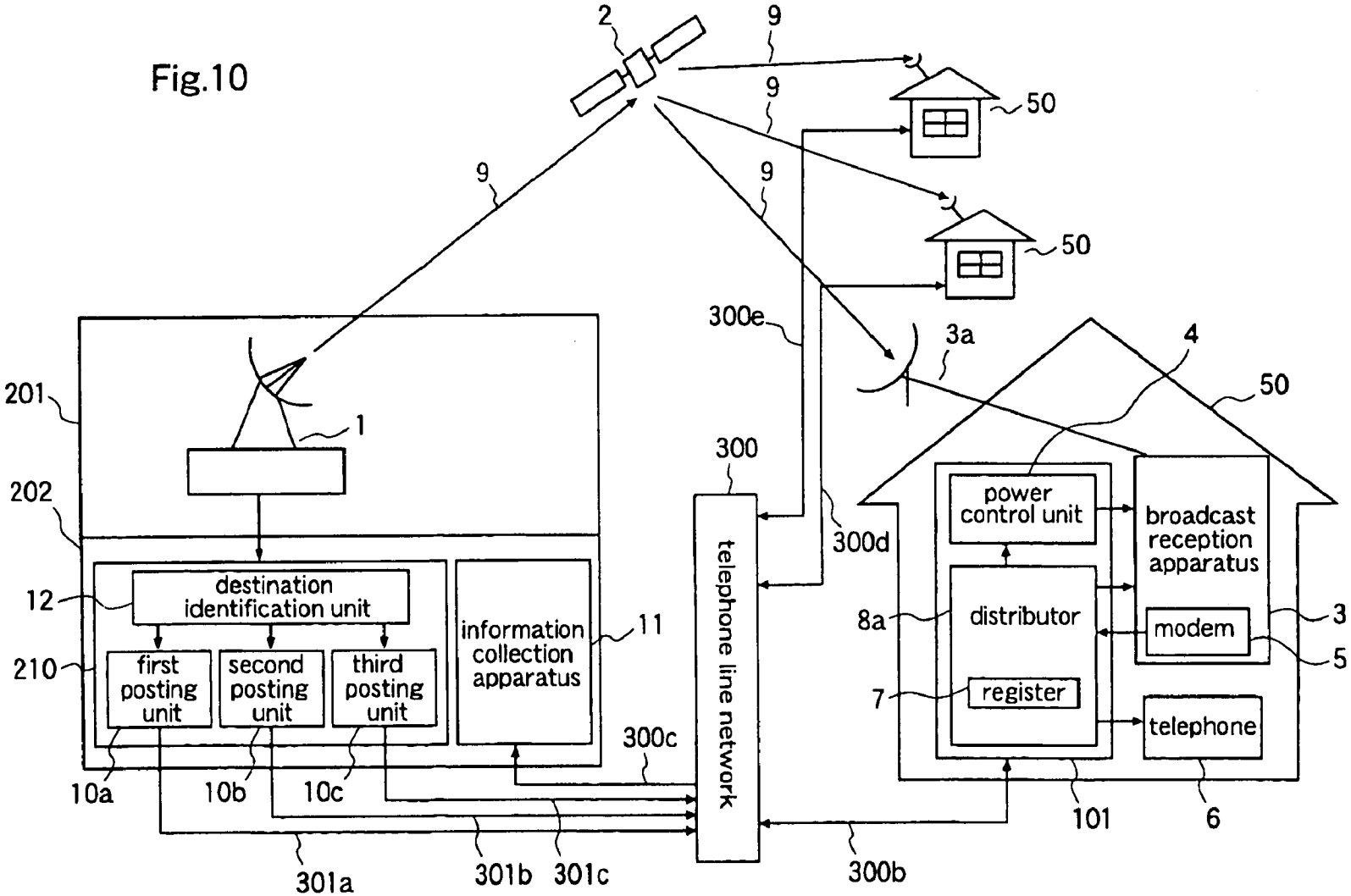
FIG. 10 is a diagram illustrating a digital broadcast transmission/reception system according to a modification of the second embodiment.

In FIG. 10, a third positing unit 10*c*, which is connected with a telephone line 301*c*, is added in the transmission posting apparatus 210. When making the broadcast reception apparatus 3 transmit accounting information, a communication call is transmitted from the third posting unit 10*c* to the power control apparatus 101, and a transmitter ID signal corresponding to this third posting unit 10*c* is stored in the register 7. When the distributor 8*a* identifies the transmitter ID signal corresponding to this third posting unit 10*c*, a control signal for making the broadcast reception apparatus 3 transmit the accounting information is transmitted to the broadcast reception apparatus 3. Thereby, transmission of the accounting information can be controlled at the transmitting end of digital broadcasting.

THIRD EMBODIMENT

Figure 3:
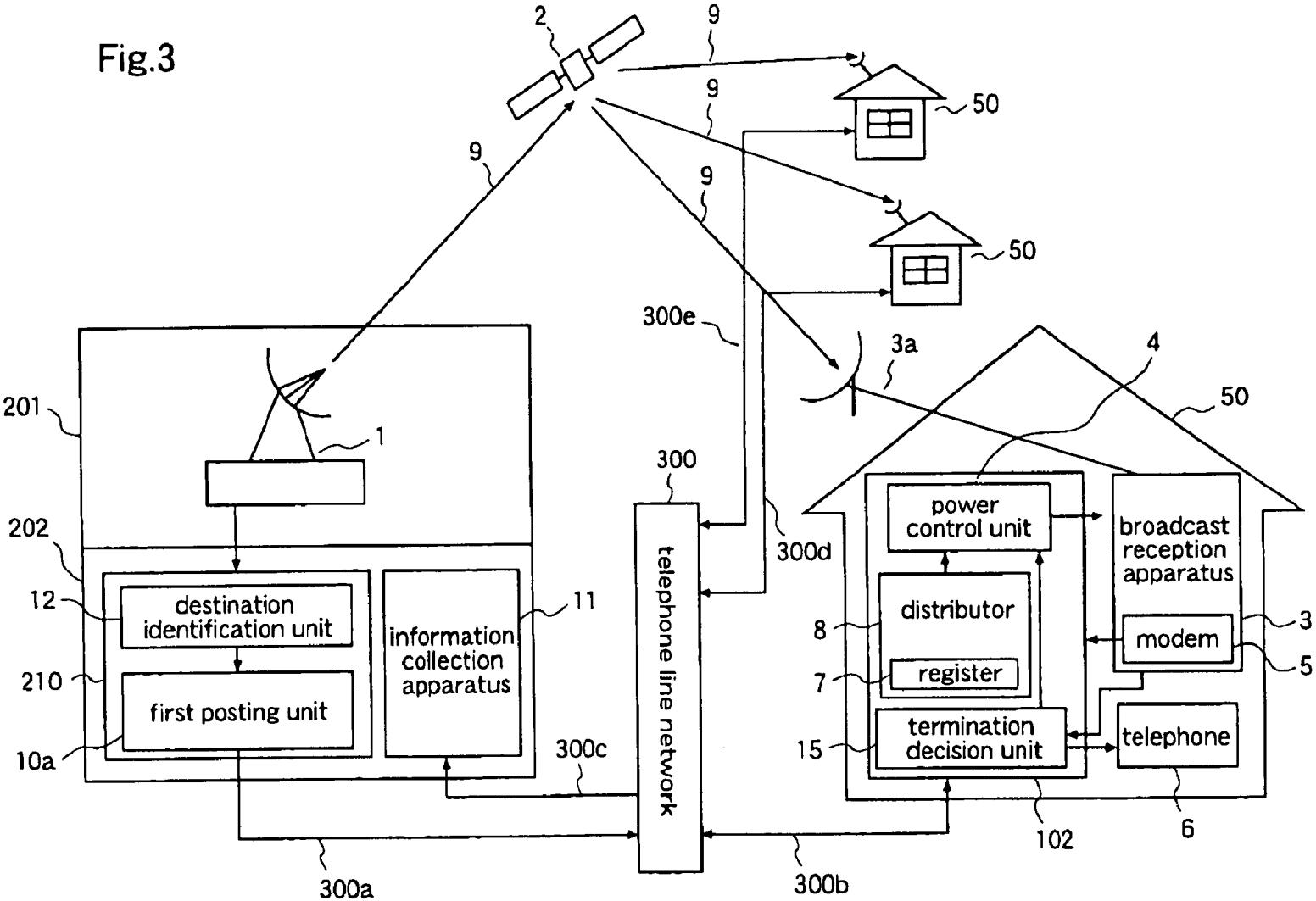
FIG. 3 is a diagram illustrating a digital broadcast transmission/reception system according to a third embodiment of the present invention.

FIG. 3 is a diagram illustrating a digital broadcasting transmission/reception system according to a third embodiment of the present invention. This digital broadcasting transmission/reception system is identical to that of the second embodiment except that the power control apparatus 102 includes a termination decision unit 15, in addition to the power control unit 4 and the distributor 8. The termination decision unit 15 decides the termination of the reception of individual information or the termination of the transmission of accounting information and, at this time, performs control to turn OFF power to the broadcast reception apparatus 3. In FIG. 3, the same reference numerals as those shown in FIG. 2 denote the same or corresponding parts.

In this third embodiment, power ON of the broadcast reception apparatus 3 is performed by transmitting a transmitter ID signal to the distributor 8*a* by a communication call from the first posting unit 10*a* at the digital broadcast transmitting end, and the distributor 8*a* transmits a power control signal for power ON to the power control unit 4 when the distributor 8*a* identifies the transmitter ID signal from the first posting unit 10*a*.

Further, power OFF is controlled by transmitting a control signal for power OFF from the termination decision unit 15 to the power control unit 4 when the termination decision unit 15 decides that the transmission of individual data such as an EMM is terminated.

Thereby, the same effects as those described for the second embodiment are achieved and, furthermore, the processing load at the transmitting end is reduced because the transmission posting apparatus 210 contacts the receiver 50 only immediately before starting transmission of the individual information.

Figure 7:
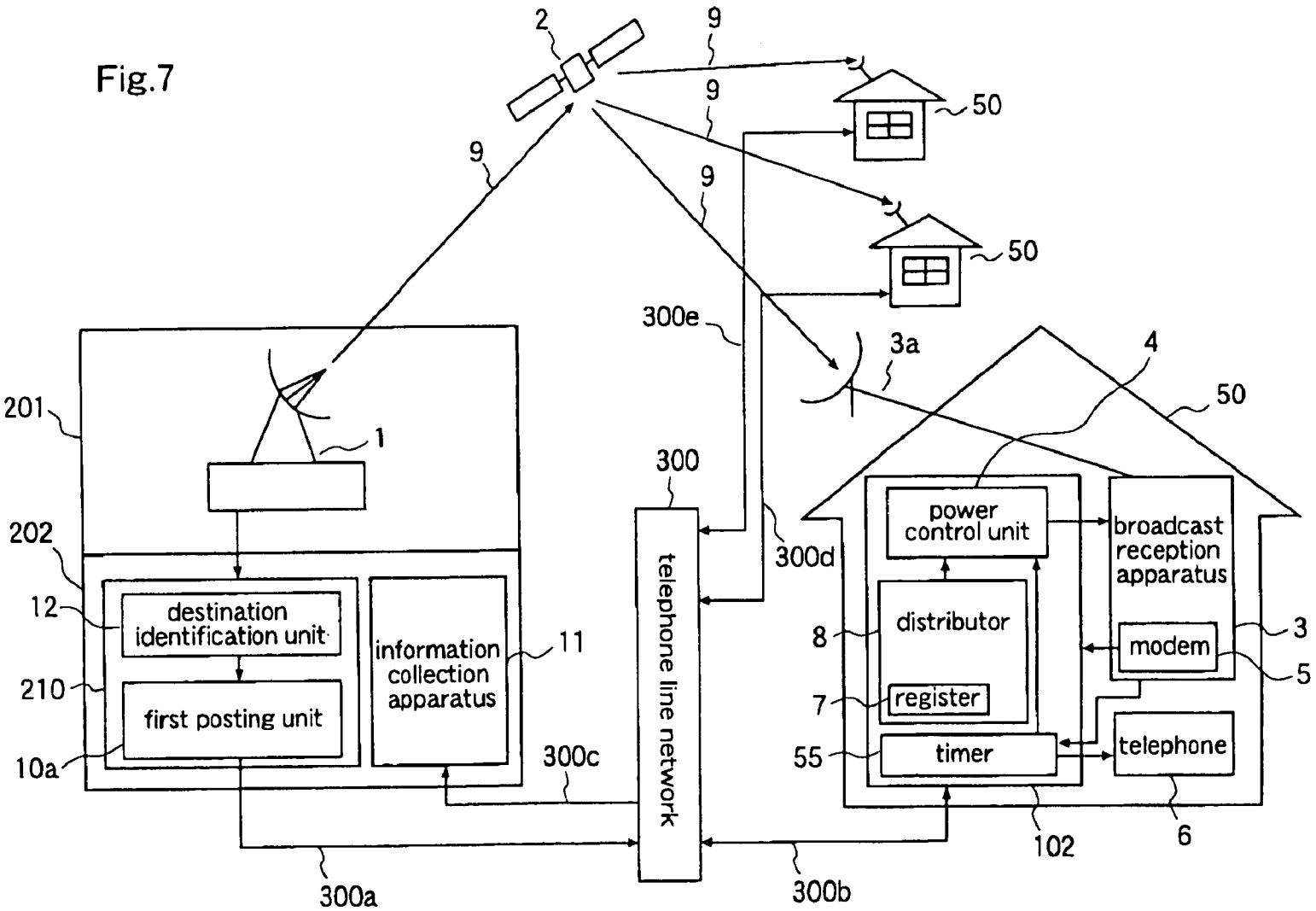
FIG. 7 is a diagram illustrating a digital broadcast transmission/reception system according to a modification of the third embodiment.

In this third embodiment, the power to the broadcast reception apparatus 3 is turned OFF when the termination decision unit 15 decides that there is a termination of the transmission of the individual information. However, as shown in FIG. 7, a timer 55 may be used instead of the termination decision unit 15 to turn OFF the power to the broadcast reception apparatus 3. To be specific, in FIG. 7, the power control apparatus 102 is provided with a timer 55 which can manage the time. The timer 55 manages the time from when the power control apparatus 102 has turned ON the power of the broadcast reception apparatus 3. When a predetermined period of time has passed, the timer 55 regards that the transmission of individual information is completed, and transmits a control signal to the power control unit 4 so as to make the power control unit 4 turn OFF the power of the broadcast reception apparatus 3. In this case, the same effects as described above are also achieved.

Furthermore, in this third embodiment, only the power ON control for the broadcast reception apparatus 3 is performed according to the communication call from the transmission posting apparatus 210 while the power OFF control is performed by using the termination decision unit 15. However, the power ON control may be performed by using an apparatus which can control another apparatus based on a time setting, such as a timer, while performing the power OFF control according to a communication call from the transmission posting apparatus 210. In this case, the same effects as described above are also achieved.

While an emphasis has been placed on a digital broadcasting transmission/reception system in the first to third embodiments, the present invention may be applied to other systems having apparatuses to be remote-controlled, with the same effects as described for the first to third embodiments.

FOURTH EMBODIMENT

Figure 4:
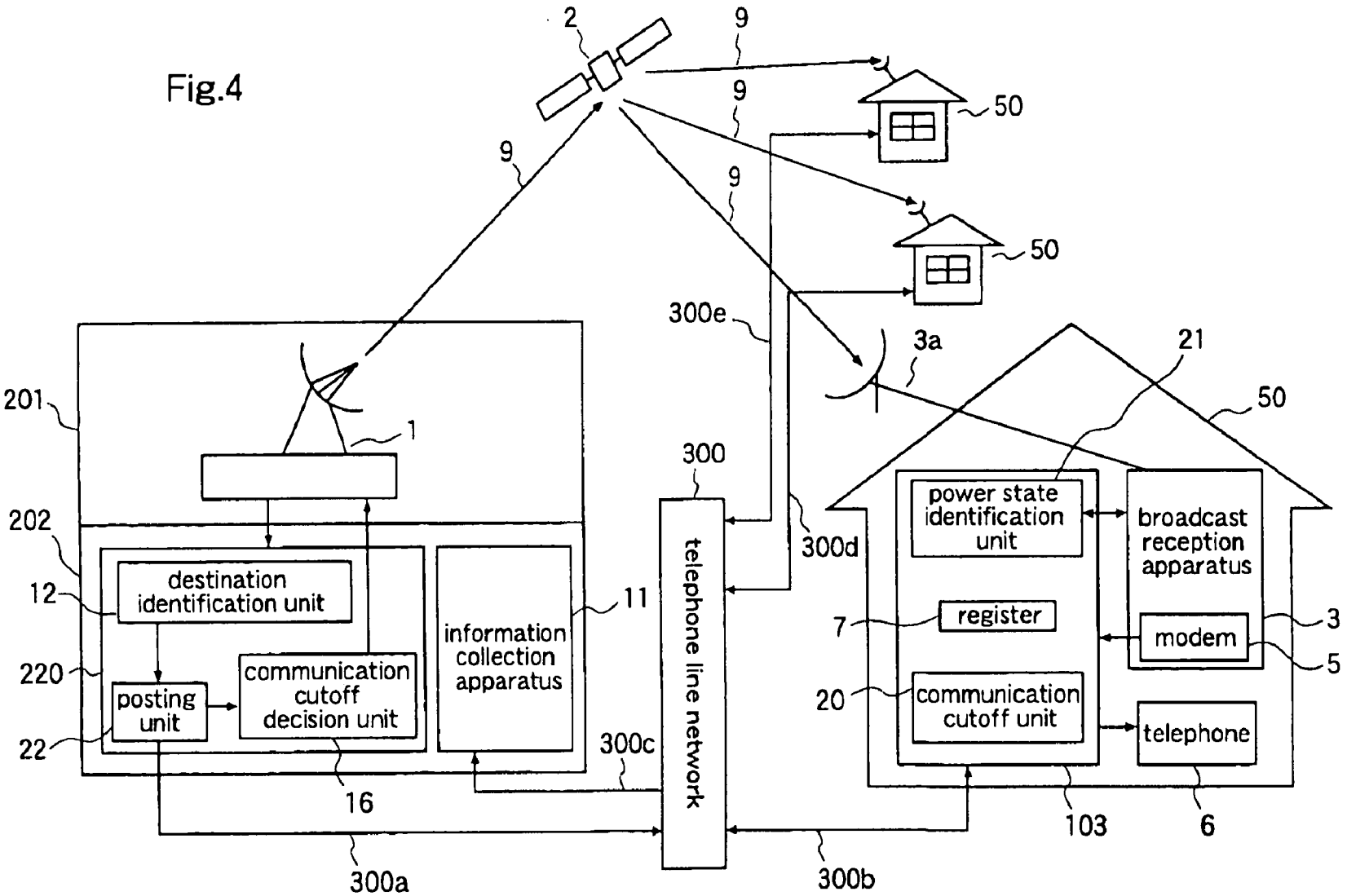
FIG. 4 is a diagram illustrating a digital broadcast transmission/reception system according to a fourth embodiment of the present invention.

FIG. 4 is a diagram for explaining a digital broadcast transmission/reception system according to a fourth embodiment of the present invention. In FIG. 4, the same reference numerals as those shown in FIG. 1 denote the same or corresponding parts. A power state identification apparatus 103 is connected with a telephone line 300*b* and a telephone 6. The power state identification apparatus 103 comprises a register 7, a power state identification unit 21 for identifying the power state of the broadcast reception apparatus 3, i.e., for deciding whether the power of the broadcast reception apparatus 3 is turned ON or OFF, and a communication cutoff unit 20 for cutting communication through the telephone line 300*b*. The power state identification apparatus 103 and the broadcast reception apparatus 3 constitute a digital broadcast reception system. A communication cutoff decision apparatus 220 comprises a destination identification unit 12, a posting unit 22 for performing a communication call, and a communication cutoff decision unit 16 for deciding whether or not communication through the telephone line 300*a* is cut off. The posting unit 22 is connected to the destination identification unit 12, the communication cutoff decision unit 16, and the telephone line 300*a*. The result of the decision by the communication cutoff decision unit 16 is transmitted to the broadcast transmission apparatus 1. The communication cutoff decision apparatus 220, the broadcast transmission apparatus 1, and the information collection apparatus 11 constitute a digital broadcast transmission system.

The operation of the digital broadcast transmission/reception system of the fourth embodiment will now be described. Transmission of ordinary digital broadcast programs from the transmitter 1 and transmission of accounting information or the like from the receiver 50 are identical to those already described for the first embodiment and, therefore, do not require repeated description.

Hereinafter, a description will be given of the case where individual information such as an EMM is transmitted by digital broadcasting. When the broadcast transmission apparatus 1 creates transmission data of individual information and transmits this as a digital broadcast, the destination identification unit 12 initially identifies a specific receiver 50 to which this information is to be transmitted. Then, the destination identification unit 12 checks the destination on the telephone line network 300 (i.e., the telephone number) corresponding to the receiver 50 to which the information is to be transmitted, and outputs this to the posting unit 22. Upon receipt of the telephone number, the posting unit 22 makes a communication call to the receiver 50 through the telephone line 300*a* and the telephone line network 300.

At this time, a transmitter ID signal of the posting unit 22 and a subsequent communication call signal of a predetermined period of time, which are given to the positing unit 22, are transmitted to the receiver 50.

On the other hand, the receiver 50 to which the individual information is transmitted previously records the transmitter ID signal of the posting unit 22, i.e., the telephone number, in the register 7 of the power state identification apparatus 103. Further, the power state identification unit 21 previously identifies the power state of the broadcast reception apparatus 3 and holds the result thereof.

When the transmitter ID signal is transmitted from the posting unit 22 through the telephone line 300*b*, the power state identification apparatus 103 decides whether or not the transmitter ID signal is stored in the register 7. When the transmitter ID signal is stored in the register 7, the power state identification apparatus 103 decides that this signal is transmitted from the posting unit 22, and refers to the power state identification unit 21 for the power state of the broadcast reception apparatus 3. When the broadcast reception apparatus 3 is in the power ON state, communication through the telephone line 300*b* is compulsorily cut off by the communication cutoff unit 20 before a communication call signal is transmitted. On the other hand, when the broadcast reception apparatus 3 is in the power OFF state, communication is not cut off.

When the transmitter ID signal is not stored in the register 7, the power state identification apparatus 103 decides that the transmitter ID signal is not transmitted from the posting unit 22, and connects the telephone line 300*b* with the telephone 6 which is provided outside of (external to) the power state identification apparatus 103.

The communication cutoff decision unit 16 monitors the communication call from the posting unit 22, and when the connection is compulsorily cut off at the receiving end during the communication call, the communication cutoff decision unit 16 recognizes this and informs the broadcast transmission apparatus 1 that the broadcast reception apparatus 3 of the specific receiver 50 is in the power ON state and so the transmission apparatus I may transmit the individual information to the receiver 50. Upon receipt of this, the broadcast transmission apparatus 1 transmits the individual information to the receiver 50. When the communication is not compulsorily cut off, the communication cutoff decision unit 16 decides that the broadcast reception apparatus 3 is in the power OFF state, and instructs the broadcast transmission apparatus 1 not to transmit the individual information.

In this fourth embodiment, the digital broadcast transmitting end can decide whether the broadcast reception apparatus 3 of the receiver 50 is in the power ON state or in the power OFF state before transmitting the individual information. Therefore, transmission of individual information is avoided when the broadcast reception apparatus 3 is in the power OFF state, and as a result, unnecessary transmission is reduced.

Further, at the receiving end, individual information is transmitted only when the broadcast reception apparatus 3 is in the power ON state. Therefore, it is not necessary to always set the apparatus 3 in the power ON state to receive the individual information, that is, the power of the broadcast reception apparatus 3 can be turned OFF when a program is not viewed, resulting in energy saving.

Further, confirmation of the power state of the broadcast reception apparatus 3 through the telephone line is performed by using the transmitter ID signal and the communication call signal. Therefore, it is not necessary to use the telephone conversation state for which the fee is charged, whereby the cost for confirming the power state is reduced.

While communication is compulsorily cut off when the broadcast reception apparatus 3 is in the power ON state in the fourth embodiment, communication may be compulsorily cut off when the reception apparatus 3 is in the power OFF state, with the same effects as described above.

Figure 8:
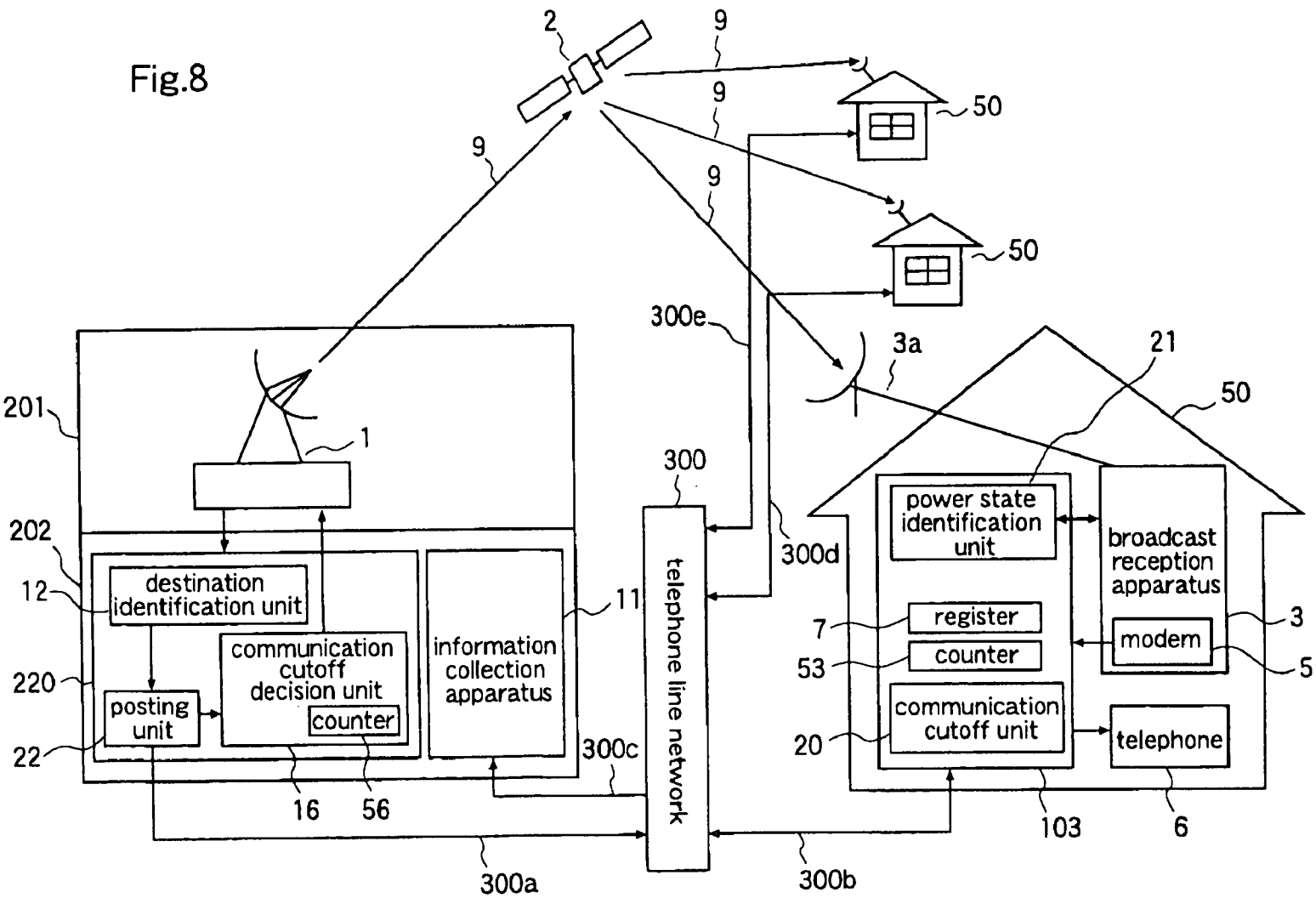
FIG. 8 is a diagram illustrating a digital broadcast transmission/reception system according to a modification of the fourth embodiment.

Further, while communication is compulsorily cut off at the timing when the transmitter ID signal is transmitted when the broadcast reception apparatus 3 is in the power ON state in the fourth embodiment, communication cutoff may be controlled by using counters 53 and 56 as shown in FIG. 8. To be specific, as shown in FIG. 8, the communication cutoff decision unit 16 and the power state identification apparatus 103 are respectively provided with counters 56 and 53 which are able to count the time of a communication call signal. Further, the call times of communication call signals corresponding to the power ON state and the power OFF state are set in advance. The power state identification apparatus 103 cuts off the communication by using the communication cutoff unit 20 when the count of the communication call signal by the counter 53 reaches the set value, in accordance with the information about the power state of the broadcast reception apparatus 3 which is held in the power state recognition unit 21. The communication cutoff decision unit 22 counts the call time until the communication cutoff occurs by using the counter 56, and decides the power state of the broadcast reception apparatus 3 based on the count, and transmits the result of the decision to the broadcast transmission apparatus 1. In this case, the same effects as described above are also achieved.

While emphasis has been placed on a digital broadcast transmission/reception system in the fourth embodiment, the present invention may be applied to other systems having apparatuses for which confirmation of the power states or the like from distant places is required.

FIFTH EMBODIMENT

Figure 5:
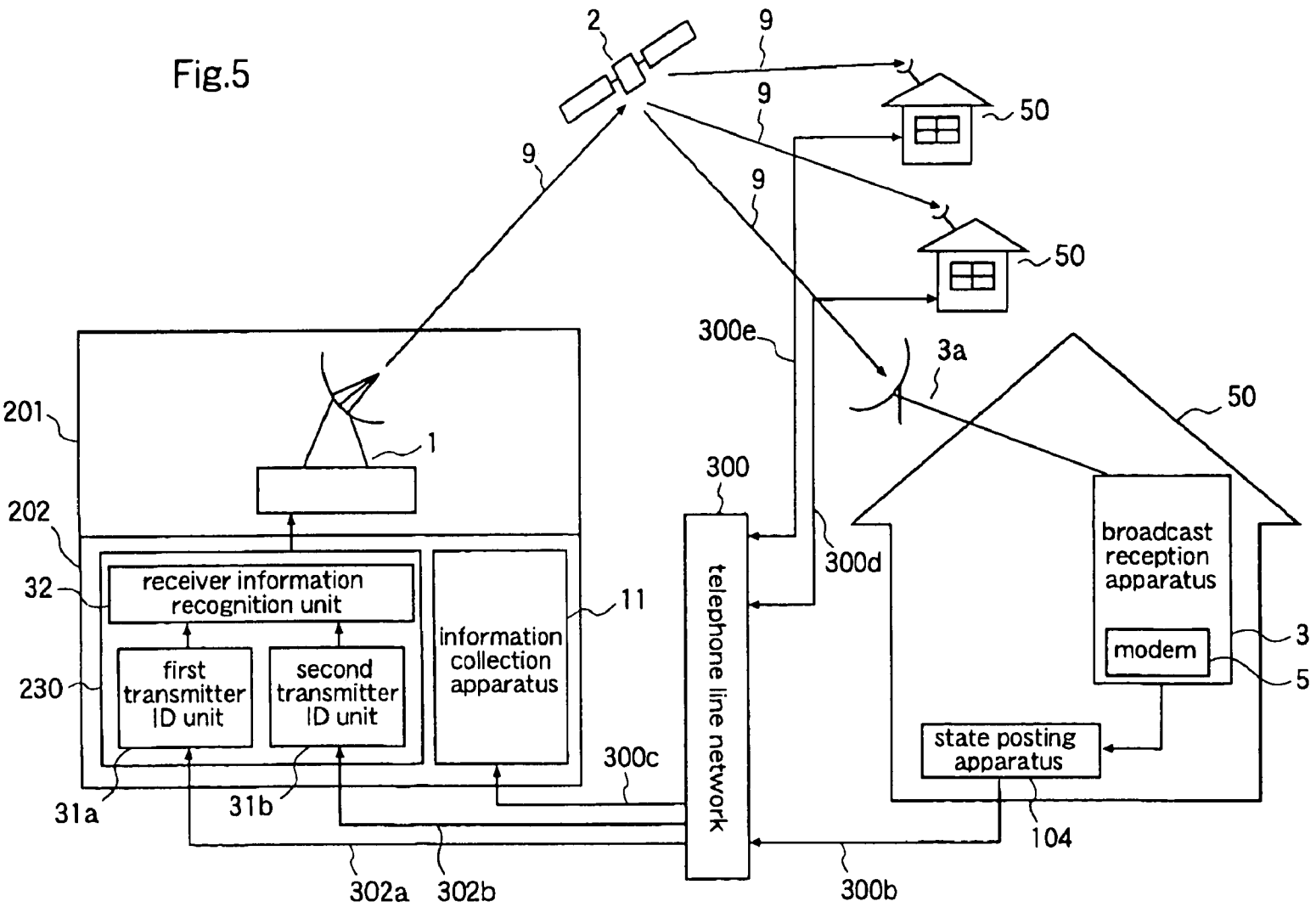
FIG. 5 is a diagram illustrating a digital broadcast transmission/reception system according to a fifth embodiment of the present invention.
Figure 6:
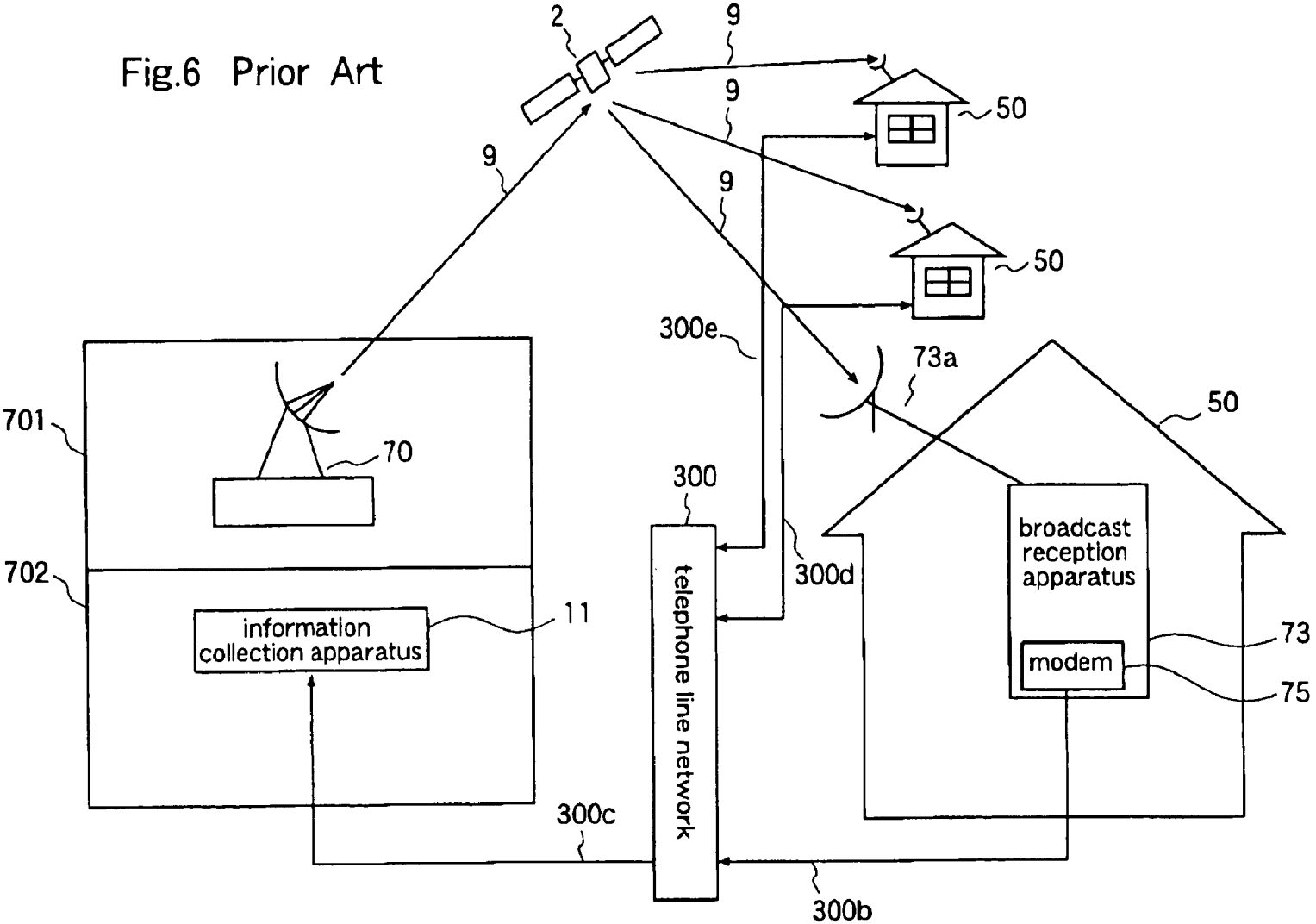
Fig.6 Prior Art
FIG. 6 is a diagram illustrating a conventional digital broadcast transmission/reception system.

FIG. 5 is a diagram illustrating a digital broadcast transmission/reception system according to a fifth embodiment of the present invention. In FIG. 5, the same reference numerals as those shown in FIG. 1 denote the same or corresponding parts. A state posting apparatus 104 is connected with the broadcast reception apparatus 3 and the telephone line 300*b*. A state recognition apparatus 230 comprises first and second transmitter identification units 31*a* and 31*b* which are connected with the telephone line network 300 through different telephone lines 302*a* and 302*b*, respectively, and a receiver information recognition unit 32 which is connected with the first and second transmitter identification units 31*a* and 31*b*. The state posting apparatus 104 and the broadcast reception apparatus 3 constitute a digital broadcast reception system.

The state recognition apparatus 230, the broadcast transmission apparatus 1, and the information collection apparatus 11 constitute a digital broadcast transmission system.

The operation of the digital broadcast transmission/reception system of the fifth embodiment will now be described. Transmission of ordinary digital broadcast programs from the transmitter and transmission of accounting information or the like from the receiver are identical to those already described for the first embodiment and, therefore, do not require repeated description.

Hereinafter, a description will be given of the case where individual information is transmitted by digital broadcasting. Initially, the state posting apparatus 104 monitors the power state of the broadcast reception apparatus 3, and performs a communication call to the first transmitter identification unit 31*a* through the telephone line network 300 immediately before or after the power of the broadcast reception apparatus 3 is turned ON. Immediately before or after the power of the broadcast reception apparatus 3 is turned OFF, the state posting apparatus 104 performs a communication call to the second transmitter identification unit 31*b*. According to the communication call, a transmitter ID signal of the state posting apparatus 104 is transmitted to one of the first and second transmitter identification units 31*a* and 31*b*.

Upon receipt of this communication call, each of the first and second transmitter identification units 31*a* and 31*b* identifies the receiver 50 from which the transmitter ID signal at the beginning of the communication call is transmitted.

The receiver 50 which is identified by the first or second transmitter identification unit 31*a* or 31*b* transmits information to the receiver information recognition unit 32 indicating that the receiver 50 has received the communication call. In the receiver information recognition unit 32, correspondence between the transmitter identification units 31*a* and 31*b* and the corresponding power states of the broadcast reception apparatus 3 is recorded. When the transmitter ID signal is input to the first transmitter identification unit 31*a*, it is decided that the power to the broadcast reception apparatus 3 of the receiver 50 which has transmitted this transmitter ID signal is turned ON. When the transmitter ID signal is input to the second transmitter identification unit 31*b*, it is decided that the power to the broadcast reception apparatus 3 of the receiver 50 which has transmitted this transmitter ID signal is turned OFF. Then, the receiver information recognition unit 32 decides one of the transmitter ID signals which is received by the transmitter identification units 31*a* and 31*b*, which one has most recently transmitted from the same receiver, recognizes that the power state of the broadcast reception apparatus 3 which is possessed by the receiver 50 is equal to the power state corresponding to either the first transmitter identification unit 31*a* or the second transmitter identification unit 31*b* which has received the latest transmitter ID signal, and posts the result of decision to the broadcast transmission apparatus 1.

The broadcast transmission apparatus 1 grasps the power ON state of the broadcast reception apparatus 3 based on the result of this decision, and transmits individual information as required when the apparatus 3 is in the power ON state.

In this fifth embodiment, since the state recognition apparatus 230 can recognize that the power to the broadcast reception apparatus 3 of the receiver 50 is turned ON or OFF, transmission of individual information is avoided when the broadcast reception apparatus 3 of the destination receiver 50 is in the power OFF state, whereby unnecessary transmission is reduced.

Further, at the receiving end, since the individual information is transmitted only when the power ON state of the broadcast reception apparatus 3 is confirmed, it is not necessary to always set the reception apparatus 3 in the power ON state to receive the individual information; that is, the power to the reception apparatus 3 can be turned OFF while not viewing a program, thereby resulting in energy saving.

Further, posting of the power state by the state posting apparatus 104 through the telephone line uses only the transmitter ID signal. Thus, it is not necessary to use the telephone conversation state for which the fee is charged, thereby reducing the cost for confirming the power state.

Figure 9:
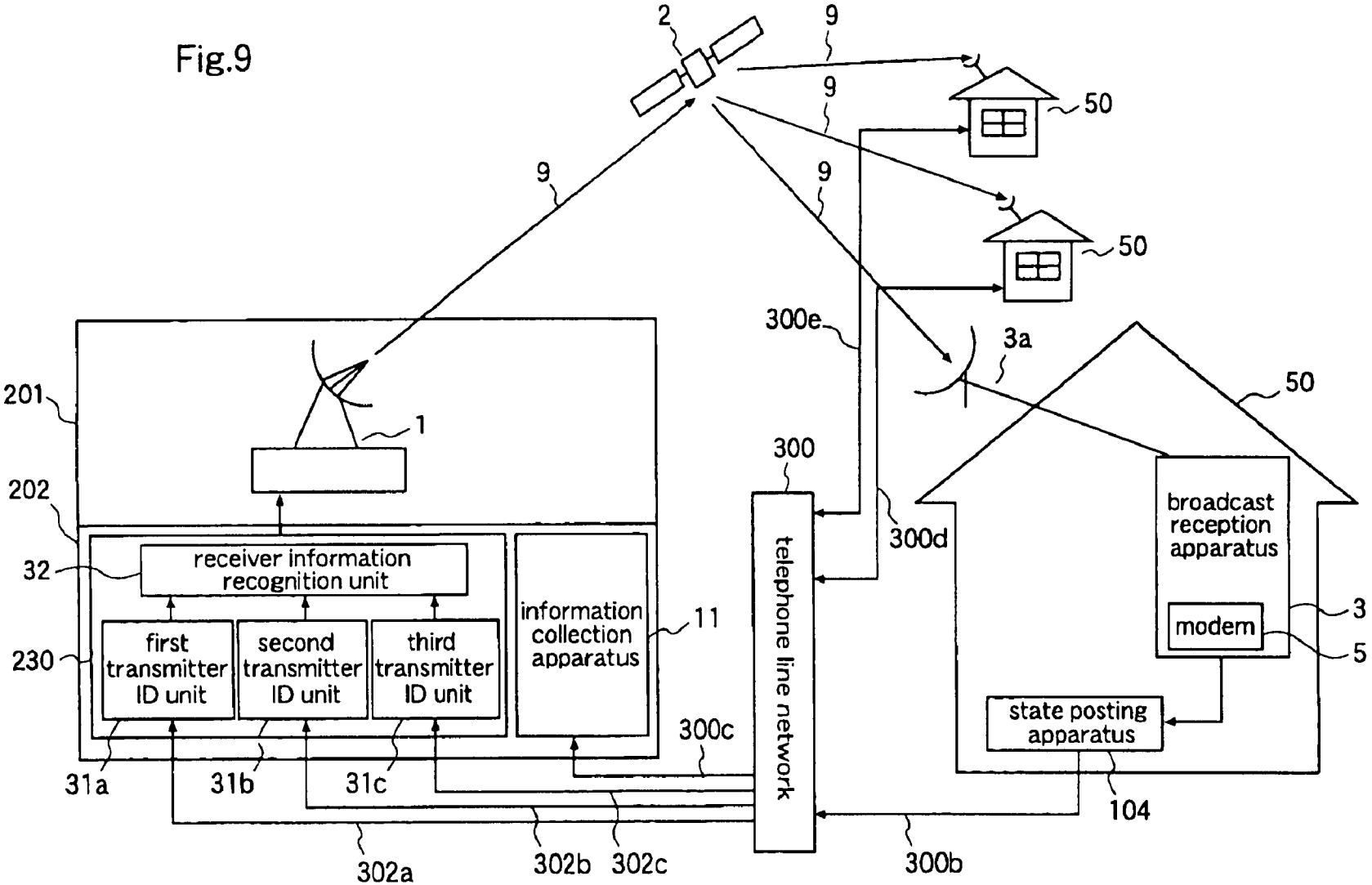
FIG. 9 is a diagram illustrating a digital broadcast transmission/reception system according to a modification of the fifth embodiment.

In this fifth embodiment, the state recognition unit 230 posts only the power state of the broadcast reception apparatus 3. However, the state recognition unit 230 may be provided with another (at least one) transmitter identification unit, and the state of the broadcast reception apparatus 3 other than the power state may be posted to this at least one additional transmitter identification unit by transmitting a transmitter ID signal from the state posting apparatus 104. For example, as shown in FIG. 9, a third transmitter identification unit 31*c*, which is connected with a telephone line 302*c*, is added in the state recognition apparatus 230, and the state where the accounting information is not updated is transmitted from the state posting apparatus 104 to the third transmitter identification unit 31*c*, whereby the digital broadcast transmitting end is prevented from transmitting a signal for requesting the accounting information. In this case, the number of times the accounting information is transmitted from the receiver 50 to the transmitting end through the telephone line can be reduced, thereby saving the telephone charge.

Figure 11:
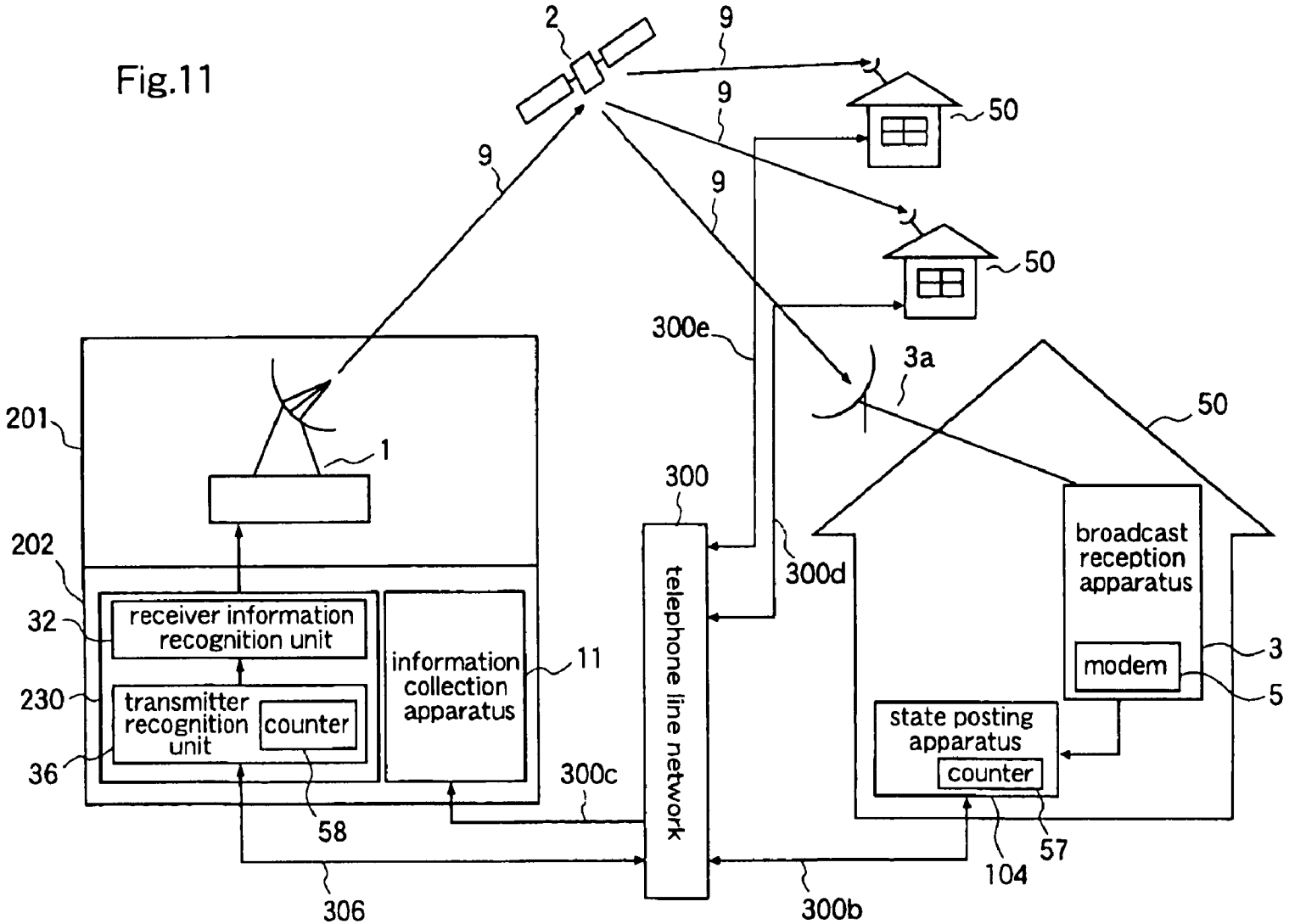
FIG. 11 is a diagram illustrating a digital broadcast transmission/reception system according to another modification of the fifth embodiment.

While a plurality of transmitter identification units are connected with different telephone lines in the fifth embodiment, only one transmitter identification unit connected with a telephone line may be employed as shown in FIG. 11. To be specific, in FIG. 11, a transmitter identification unit 36 having the same structure as the first and second transmitter identification units shown in FIG. 5 is connected with a telephone line 306. The state posting apparatus 104 and the transmitter identification unit 36 are respectively provided with counters 57 and 58 which are able to count the time of the communication call signal. Further, the call times of communication call signals corresponding to the power ON state and the power OFF state of the broadcast reception apparatus 3 are set in advance. The state posting apparatus 104 performs a communication call to the transmitter according to the change of the power state of the broadcast reception apparatus 3, and cuts off the communication at the timing when the count of the communication call signal by the counter 57 reaches the above-described set value. The transmitter identification unit 36 identifies the transmitter by the transmitter ID signal of the communication call, and counts the call time of the communication call signal by using the counter 58 until the communication call is cut off. Based on the count, the receiver information recognition unit 32 decides the power state of the broadcast reception apparatus 3 of the receiver 50. In this case, the same effects as described above are also achieved. In this case, the state of the broadcast reception apparatus 3 other than the power state may be posted according to a communication call signal which has been predetermined according to this state.

While emphasis has been placed on a digital broadcast transmission/reception system in the fifth embodiment, a state recognition system comprising a state posting apparatus and a state recognition apparatus according to the present invention may be applied to other systems having apparatuses for which posting of the power states or the like from distant places is required. In this case, the same effects as described above are also achieved.

While a transmitter ID signal and a communication call signal are exchanged between a digital broadcast transmission system and a digital broadcast reception system by using a telephone line in the first to fifth embodiments, another communication line which is capable of transmitting a specific transmitter ID signal when performing a communication call may be employed instead of the telephone line.

What is claimed is:

1. A power control apparatus operable to enable control of a main power of an apparatus, on which power control of the apparatus is performed, without being in conjunction with the main power of the apparatus, said power control apparatus comprising either on a separate power not in conjunction with the main power of the apparatus or on a separate apparatus:

a distributor having storage means in which transmitter ID signals for identifying transmitters are stored, said distributor being operable to compare a inputted transmitter ID signal, which is input through a predetermined communication line in advance of a communication call signal, with the transmitter ID signals stored in said storage means, to output a power control signal when the inputted transmitter ID signal matches any of the transmitter ID signals stored in said storage means, and to connect the communication line with a predetermined communication apparatus when the inputted transmitter ID signal does not match any of the transmitter ID signals stored in said storage means; and a power control unit operable to control ON or OFF of power to the predetermined apparatus which is connected to said distributor according to the power control signal supplied from said distributor.

2. The power control apparatus of claim 1 wherein:

said storage means stores a plurality of transmitter ID signals;

said distributor outputs a plurality of power control signals respectively corresponding to the transmitter ID signals which are stored in said storage means and which match inputted transmitter ID signals; and said power control unit operable to perform control to turn ON the power of the predetermined apparatus and to turn OFF the power of the predetermined apparatus according to power control signals supplied from said distributor.

3. The power control apparatus of claim 2, wherein:

said storage means stores a transmitter ID signal corresponding to a predetermined process of the predetermined apparatus which is subjected to the power ON control or the power OFF control by said power control unit; and when the inputted transmitter ID signal matches the transmitted ID signal stored in said storage means, said distributor is operable to output a control signal for instructing the predetermined apparatus to perform the predetermined process corresponding to the inputted transmitter ID signal.

4. The power control apparatus of claim 1, wherein:

said distributor is provided with count means for counting a communication call time by the communication call signal which is input after the inputted transmitter ID signal through the predetermined communication line;

said storage means stores a plurality of communication call time information;

when the inputted transmitter ID signal matches any of the stored transmitter ID signals, said distributor is operable to compare the result of the count by said counting means with the communication call time information stored in said storage means, and to output a power control signal corresponding to the communication call time which matches the result of the count by said counting means; and said power control unit operable to perform either the power ON control or the power OFF control; according to the power control signal supplied from said distributor.

5. The power control apparatus of claim 4, wherein:

said storage means stores communication call time information corresponding to a predetermined process of the predetermined apparatus which is subjected to the power ON or OFF control by said power control apparatus; and when the result of the count by said count means matches the communication call time information which corresponds to the predetermined apparatus and which is stored in said storage means, said distributor is operable to output a control signal for instructing the predetermined apparatus to perform the predetermined process corresponding to this communication call time information.

6. The power control apparatus of claim 1, further comprising termination decision means for deciding whether a predetermined process of the predetermined apparatus is terminated, and outputting a power control signal to said power control unit to turn OFF the power of the predetermined apparatus when the predetermined process of the predetermined apparatus is terminated.

7. The power control apparatus of claim 1 further comprising time managing means for outputting to said power control unit either a power control signal to turn ON the power or a power control signal to turn OFF the power, based on a predetermined time setting.

8. A power state identification apparatus operable to enable control of a main power of an apparatus on which power control of the apparatus is performed without being in conjunction with the main power of the apparatus, said power control apparatus comprising either on a separate power not in conjunction with the main power of the apparatus or on a separate apparatus:

storage means in which transmitter ID signals for identifying transmitters are stored;

power state identification means for identifying a power state of a predetermined apparatus and holding the power state of the predetermined apparatus; and communication cutoff means for cutting communication through a predetermined communication line; wherein:

an inputted transmitter ID signal which is input through the predetermined communication line in advance of a communication call signal is compared with the transmitter ID signals stored in said storage means;

when the inputted transmitter ID signal matches any of the transmitter ID signals stored in said storage means, whether or not the power state of the predetermined apparatus is in a predetermined state is decided based on the power state information held in said power state identification means;

when said the predetermined apparatus is determined to be in the predetermined power state, said communication cutoff means cuts off the communication through the communication line; and when the inputted transmitter ID signal does not match any of the stored transmitter ID signals, the communication line is connected with a predetermined communication apparatus.

9. A power state identification apparatus operable to enable control of a main power of an apparatus on which power control of the apparatus is performed, without being in conjunction with the main power of the apparatus, said power control apparatus comprising either on a separate power not in conjunction with the main power of the apparatus or on a separate apparatus:

storage means in which transmitter ID signals for identifying transmitters are stored;

power state identification means for identifying a power state of a predetermined apparatus and holding identification information of the power state of the predetermined apparatus;

counting means for counting a call time of a communication call signal which is input subsequently to the transmitter ID signal through the predetermined communication line; and communication cutoff means for cutting communication through the predetermined communication line; wherein:

an inputted transmitter ID signal which is input through the predetermined communication line is compared with the transmitter ID signals stored in said storage means;

when the inputted transmitter ID signal matches any of the stored transmitter ID signals, the power state of the predetermined apparatus is decided based on the power state information held in said power state identification means, and said counting means counts the communication call signal;

when the call time being counted by said counting means reaches a predetermined time, said communication cutoff means cuts off the communication; and when the inputted transmitter ID signal does not match any of the stored transmitter ID signals, the communication line is connected with a predetermined communication apparatus.

* * * * *